US008581801B2

(12) United States Patent
Puzella et al.

(10) Patent No.: US 8,581,801 B2
(45) Date of Patent: Nov. 12, 2013

(54) DROOPY BOWTIE RADIATOR WITH INTEGRATED BALUN

(75) Inventors: Angelo M. Puzella, Marlborough, MA (US); Sergey Makarov, Holden, MA (US); Patrick Morrison, Jefferson, MA (US)

(73) Assignee: Raytheon Company, Waltham, MA (US)

( * ) Notice: Subject to any disclaimer, the term of this patent is extended or adjusted under 35 U.S.C. 154(b) by 685 days.

(21) Appl. No.: 12/791,150

(22) Filed: Jun. 1, 2010

(65) Prior Publication Data

US 2011/0291907 A1 Dec. 1, 2011

(51) Int. Cl.
*H01Q 1/12* (2006.01)

(52) U.S. Cl.
USPC ..... 343/878; 343/700 MS; 343/795; 343/797

(58) Field of Classification Search
USPC ..... 343/808, 878, 888, 890, 700 MS, 795, 343/797, 898
See application file for complete search history.

(56) References Cited

U.S. PATENT DOCUMENTS

| | | | | |
|---|---|---|---|---|
| 2,935,747 | A * | 5/1960 | Ghose | 343/767 |
| 4,686,536 | A * | 8/1987 | Allcock | 343/700 MS |
| 5,293,176 | A | 3/1994 | Elliot | |
| 5,628,057 | A | 5/1997 | Philips et al. | |
| 5,796,372 | A | 8/1998 | Elliot | |
| 6,204,825 | B1 | 3/2001 | Wilz | |
| 6,211,751 | B1 | 4/2001 | Aoki | |
| 6,329,649 | B1 * | 12/2001 | Jack et al. | 250/250 |
| 6,359,596 | B1 | 3/2002 | Claiborne | |
| 6,480,167 | B2 | 11/2002 | Matthews | |
| 8,299,976 | B2 * | 10/2012 | Lenzi et al. | 343/793 |
| 2005/0104780 | A1 | 5/2005 | Gottwald et al. | |
| 2007/0126651 | A1 | 6/2007 | Snyder et al. | |
| 2007/0188398 | A1 | 8/2007 | Mohuchy et al. | |
| 2009/0096704 | A1 | 4/2009 | Makarov et al. | |

FOREIGN PATENT DOCUMENTS

| | | | |
|---|---|---|---|
| EP | 1 041 671 | A1 | 10/2000 |
| GB | 2 316 233 | A | 2/1998 |
| WO | WO 2010/054227 | A1 | 5/2010 |

OTHER PUBLICATIONS

International Preliminary Report on Patentability of the ISA for PCT/US2011/036735 dated Dec. 13, 2012.
Partial Search Report with Invitation to Pay Additional Fees in PCT/US2011/036735 dated Aug. 4, 2011.
Bayard et al.; "Analysis of Infinite Arrays of Printed Dipoles on Dielectric Sheets Perpendicular to a Ground Plane;" IEEE Transactions on Antennas and Propagation, vol. 39, No. 12; Dec. 1991; pp. 1722-1732.
Chen et al.; "Low Uncertainty Broadband EMC Measurement using Calculable Precision Biconical Antennas;" IEEE International Symposium Electromagnetic Capability, vol. 2; Jan. 2000; pp. 505-510.

(Continued)

*Primary Examiner* — Tho G Phan
(74) *Attorney, Agent, or Firm* — Daly, Crowley, Mofford & Durkee, LLP

(57) ABSTRACT

An antenna element and balun are described. The antenna includes a plurality of droopy bowtie antenna elements disposed on dielectric block and a feed point. The balun includes a central member having dielectric slabs symmetrically disposed on external surfaces thereof. At least one end of the balun is provided having a shape such that conductors on the dielectric slabs of the balun can be coupled to the the droopy bowtie antenna elements.

15 Claims, 16 Drawing Sheets

(56) References Cited

OTHER PUBLICATIONS

Cohn; A Class of Broadband Three-Port TEM-Mode Hybrids; IEEE Transactions on Microwave Theory and Techniques Society, vol. MIT-16, No. 2; Feb. 1968; pp. 110-116.
Dyson; "Balanced Transmission-Line Measurements Using Coaxial Equipment;" IEEE Transactions on Microwave Theory and Techniques; Jan. 1971; pp. 94-96.
Dyson; "Measurement of Near Fields of Antennas and Scatterers;" IEEE Transactions on Antennas and Propagation, vol. AP-21, No. 4; Jul. 1973; pp. 446-460.
Ellingson et al.; "Comparison of Two Candidate Elements for a 30-90 MHz Radio Telescope Array;" IEEE Antennas and Propagation Society International Symposium, vol. 1A; Jul. 2005; pp. 590-593.
Elliot; "Octave Bandwidth Microwave Scanning Array;" 1995 Antenna Applications Symposium; Sep. 1995; pp. 537-555.
Elliot et al.; "Octave Bandwidth Printed Circuit Phased Array Element;" IEEE Antennas and Propagation Society International Symposium; Jul. 2006; pp. 3743-3745.
Elsallal; Dissertation entitled High Performance Phased Arrays of Doubly Mirrored Balanced Antipodal Vivaldi Antenna (DmBAVA): Current Development and Future Considerations; 2007 Antenna Applications Symposium; Sep. 18-20, 2007; pp. 148-159.
Fitzgerrell; "Standard Linear Antennas, 30 to 1000 MHz;" IEEE Transactions on Antennas and Propagation, vol. AP-34, No. 12; Dec. 1986; pp. 1425-1429.
Gatti et al; "A Circularly Polarized Crossed Drooping Dipole Antenna;" IEEE Antennas and Propagation Society International Symposium, vol. 1; May 1990; pp. 254-257.
Gou et al.; "Wideband Dual-Polarized Patch Antenna with Broadband Baluns;" IEEE Transactions on Antennas and Propagation, vol. 55, No. 1; Jan. 2007; pp. 78-83.
Hammerstad et al.; "Accurate Models for Microstrip Computer-Aided Design;" IEEE Microwave Theory and Techniques-S International Microwave Symposium Digest; Jan. 1980; pp. 407-409.
Hoofar et al.; "Cross-Polarization Level in Radiation from a Microstrip Dipole Antenna;" IEEE Transactions on Antennas and Propagation, vol. 36, No. 9; Sep. 1988; pp. 1197-1203.
Jones et al.; "A Wide-Band Strip-Line Balun;" IRE Transactions Microwave Theory Techniques; Jan. 1959; pp. 94-96.
Kerkhoff et al.; "A Wideband Planar Dipole Antenna for Use in the Long Wavelength Demonstrator Array (LWDA);" IEEE Antennas and Propagation Society International Symposium, vol. 1B; Jul. 2005; pp. 553-556.
Kirschning et al.; "Accurate Wide-Range Design Equations for the Frequency-Dependent Characteristic of Parallel Coupled Microstrip Lines;" IEEE Transactions on Microwave Theory and Techniques, vol. MIT-32, No. 1; Jan. 1984; pp. 83-90.
Kulkarni et al.; "A Circularly Polarized UHF Antenna at 550-700 MHz;" IEEE Antennas and Propagation Society International Symposium, Jun. 9-15, 2007; pp. 2981-2984.
Lee et al.; "A General Design Formula of Multi-Section Power Divider Based on Singly Terminated Filter Design Theory;" IEEE Microwave Theory and Techniques Society International microwave Symposium Digest; Jan. 2001; pp. 1297-1300.
Lee et al.; "A Low-Profile Wide-Band (5:1) Dual-Pol Array;" IEEE Antennas and Wireless Propagation Letters, vol. 2; Jan. 2003; pp. 46-49.
Lee et al,; "Performance of a Wideband (3-14 GHz) Dual-Pol Array;" IEEE Antennas and Propagation Society International Symposium, vol. 2; Jun. 2004; pp. 551-554.
Makarov et al.; "Analytical Model of the Split-Coaxial Balun and Its Application to a Linearly-Polarized Dipole or a CP Turnstile;" IEEE Transactions on Antennas and Propagation, vol. 55, No. 7; Jul. 2007; pp. 1909-1918.
Makarov et al.; "Scan Impedance for an Infinite Dipole Array: Hansen's Formula Compared with Ansoft HFSS Simulation;" IEEE Antennas and Propagation Magazine, vol. 49, No. 4; Aug. 1007; pp. 143-156.
Makarov et al.; "Multipath Rejection by Virtue of a Chile Ring for a Broadband Droopy Turnstile Antenna;" 2007 Antenna Applications Symposium; Sep. 2007; pp. 467-507.
McLean; "Balancing Networks for Symmetric Antennas—I: Classification and Fundamental Operation;" IEEE Transactions on Electromagnetic Compatibility, vol. 44, No. 4; Nov. 2002; pp. 503-514.
McLean; "Balancing Networks for Symmetric Antennas: Part II—Practical Implementation and Modeling;" IEEE Transactions on Electromagnetic Compatibility, vol. 46, No. 1; Feb. 2004; pp. 24-32.
Mohanty et al.; "Characteristics of Printed Antennas and Arrays Covered with a Layer of Printed Strip-Grating for Suppression of Cross-Polarization;" IEEE Antennas and Propagation Society International Symposium, vol. 2; Jul. 1993; pp. 634-637.
Oraizi et al.; "Design and Optimization of Broadband Asymmetrical Multisection Wilkinson Power Divider;" IEEE Transactions on Microwave Theory and Techniques, vol. 54, No. 5; May 2006; pp. 2220-2231.
Pickles et al. "Proposed Coincident Phase Center Orthogonal Dipoles;" Antenna Applications Symposium Proceedings; Sep. 2007; pp. 106-124.
Ping et al.; "A Broadband Rolled Edged Cavity Antenna;" IEEE Antennas and Propagation Society International Symposium, vol. 1; Jun. 2004; pp. 787-790.
Pozar et al.; "Analysis of an Infinite Array of Rectangular Microstrip Patches with Idealized Probe Feeds;" IEEE Transactions on Antennas and Propagation, vol. AP-32, No. 10; Oct. 1984; pp. 1101-1107.
Suh et al.; "A Novel Low-profile, Dual-polarization, Multi-band Base-station Antenna Element—The Fourpoint Antenna;" IEEE 60$^{th}$ Vehicular Technology Conference, vol. 1; Sep. 2004; pp. 225-229.
Suh et al.; "Bandwidth Improvement for Cross-dipole Type Antennas using a Tuning Plate;" IEEE Antennas and Propagation Society International Symposium, vol. 2A; Jul. 2005; pp. 487-490.
Suh et al.; "Low-profile, Dual-polarized Broadband Antennas;" IEEE Antennas and Propagation Society International Symposium, vol. 2; Jun. 2003; pp. 256-259.
Wan; "Analytically and Accurately Determined Quasi-Static Parameters of Coupled Microstrip Lines;" IEEE Transactions on Microwave Theory and Techniques, vol. 44, No. 1; Jan. 1996; pp. 75-80.
Wilkinson; "An N-Way Hybrid Power Divider;" IRE Transactions on Microwave Theory and Techniques, vol. MII-8, No. 1; Jan. 1960; pp. 116-118.
Woelders et al.; "Cross-Polarization and Sidelobe Suppression in Dual Linear Polarization Antenna Arrays;" IEEE Transactions on Antennas and Propagation, vol. 45, No. 12; Dec. 1997; pp. 1727-1740.
Zhong et al.; "Corner-Fed Microstrip Antenna Element and Arrays for Dual-Polarization Operation;" IEEE Transactions on Antennas and Propagation, vol. 50, No. 10; Oct. 2002; pp. 1473-1480.
PCT Search Report of the ISA for PCT/US2011/036735 dated Oct. 5, 2011.
Written Opinion of the ISA for PCT/US2011/036735 dated Oct. 5, 2011.

* cited by examiner

DROOPY BOWTIE RADIATOR WITH INTEGRATED BALUN

CROSS-REFERENCE TO RELATED APPLICATIONS

Not applicable.

STATEMENT REGARDING FEDERALLY SPONSORED RESEARCH

Not applicable.

FIELD OF THE INVENTION

This application generally relates to radio frequency (RF) circuits and more particularly to an RF antenna and integrated balun.

BACKGROUND OF THE INVENTION

As is known in the art, antenna elements or radiators used in phased array antennas typically have good bandwidth or good cross-polarization isolation, but not both. For example, with proper design, an array of dipole elements can have very good cross-polarization isolation characteristics in all scan planes; however, bandwidth is limited. On the other hand, array antennas provided from notch radiators or Vivaldi radiators have excellent bandwidth, but relatively poor cross-polarization isolation off the principal axes.

Droopy bowtie elements disposed above a ground plane are a well known means for producing nominally circular polarized (CP) reception or transmission radiation patterns at frequencies from VHF to microwave wavelengths. Droopy bowtie elements are often coupled to a balun which is realized in a co-axial configuration involving separate subassemblies for achieving balun matching and arm phasing functions. Such a configuration typically results in an integrated antenna-balun assembly having good bandwidth but a poor cross-polarization isolation characteristic. Furthermore, such a configuration is relatively difficult to assemble.

It would, therefore, be desirable to provide an antenna and balun combination which results in an integrated balun-antenna element having both good bandwidth characteristics and good cross-polarization isolation characteristics.

SUMMARY OF THE INVENTION

In accordance with the concepts, systems, circuits and techniques described herein, a balun includes a central conductive member having first and second opposing ends and a conductive external surface with a plurality of microstrip transmission lines disposed over the conductive external surface.

With this particular technique, a vertical feed line balun is provided. In one embodiment, the conductive member is provided having a square cross-sectional shape and a microstrip transmission line is disposed over each of the four external surfaces of the square conductive member to provide the balun as a quad vertical feed line balun made out of four individual transmission lines disposed over a common ground conductor. In one embodiment, the balun is provided as a Dyson balun and is used to feed a radiator such as a droopy bowtie radiator. By using a central conductive member and placing pairs of microstrip transmission lines on opposing surfaces of the central conductive member, the microstrip lines are physically and electrically isolated from each other (i.e. the microstrip lines are isolated by air gaps). This provides the balun having a high cross-polarization isolation characteristic. The same quad line can be used for operation in the S-, C-, and X-frequency bands, without changing balun parameters such as the cross-sectional dimensions of the quad vertical feeding line. The balun is mechanically stable which facilitates attachment to a printed circuit board (PCB) on one end, and to a radiator on the other end. Furthermore, since the quad vertical feeding line is mechanically symmetric, it lends itself to an easier assembly process than prior art approaches using pick and place equipment. The balun also provides coincident phase centers for orthogonal dipoles as well as flexibility in choosing array lattice geometry (rectangular, triangular, etc.).

In one embodiment, the central conductive member is provided a solid conductive bar having a square or rectangular cross-sectional shape. The solid conductive bar may be provided from any conductive material (e.g. copper or brass) which provides a ground for each of the microstrip transmission lines disposed on a corresponding one of the four surfaces of the central conductive member. Thus, the microstrip transmission lines all share the same ground (i.e. the central conductive member acts as a ground for each of the transmission lines disposed thereover).

In one embodiment, the solid conductor is provided from a machining operation. Other manufacturing techniques may, of course, also be used to provide the central conductive member. In one embodiment, the microstrip transmission lines are provided by disposing a conductor over a dielectric substrate (e.g. Rogers RT/duroid 6010 PTFE Ceramic Laminate) having a relative dielectric constant ($\in_r$) in the range of about 10.2 to about 10.9 (depending upon the series) and a loss tangent of about 0.0023. In one embodiment the dielectric substrate is provided having copper (e.g. rolled or plated copper) disposed or otherwise provided (e.g. via patterning, deposition or any subtractive or additive techniques known to those of ordinary skill in the art) on both sides thereof. The transmission lines are thus provided from dielectric substrates having conductive material disposed on opposing surfaces thereof (e.g. double-sided conductive strips) with a conductor on one surface corresponding to a ground plane and the conductor on the opposing surface corresponding to a transmission line. The dielectric substrates are then coupled to the central conductive-member Such a construction provides a balun having a high isolation characteristic between two transmission line pairs feeding two antennas. The high isolation characteristic is a result of the use of a central conductor as well as the use of a dielectric substrate having a relatively high relative dielectric constant ($\in_r$). Furthermore, the transmission lines disposed about the central conductor are isolated by air gaps which also helps to increase the isolation characteristic of the balun.

It should of course, be appreciated that in other embodiments, the central conductive member may be fully hollow or partially hollow. Also, the cross-sectional shape of the central member need not necessarily be square or rectangle. Rather any cross-sectional shape may be used including circular or polygonal shapes or any other regular or irregular shapes.

In one embodiment, the use of a dielectric material having a 25 mil thickness allows fabrication of a balun having dimensions that can be used in a variety of different frequency ranges (i.e. the same balun dimensions can be used over a wide range of frequencies) and which are very convenient for mechanical assembly. For example, the same dimensions can be used for baluns operating in the X-band frequency range as well as in the S-band and C-band frequency ranges. Other dielectric material thicknesses, may of course, also be used while also providing the ability to operate over a plurality of different frequency ranges and/or frequency bands. It should, however, be appreciated that the line feed impedance (i.e. the impedance of the quad vertical feeding line) depends, in part, upon the dielectric thickness and conductor line width (e.g. for a given line width, the dielectric material thickness affects the line feed impedance but the feeding line can be used over the S-, C- and X-Bands). In one embodiment, all balun transmission lines have the same characteristic impedance of about 30 Ohms per port, assuming that opposing ports are fed out of phase by 180 degrees. This means a 60 Ohm impedance per one dipole antenna fed with two ports in series, should provide an impedance match to a bowtie radiator which allows desired operation of the integrated balun and bowtie radiator.

In accordance with the concepts, systems, circuits and techniques described herein, an integrated antenna element includes: (a) a droopy bowtie turnstile radiator having a feed point; and (b) a quad line vertical balun having one end electrically coupled to the feed point of the radiator. In one embodiment, the quad line vertical balun includes a central member provided from a conductive material and a plurality of microstrip transmission lines disposed about the central member and sharing a ground plane provided by the central member.

With this particular arrangement, an integrated antenna-balun combination (also referred to herein as an integrated antenna element) is provided which allows operation over a relatively wide range of frequencies while at the same time providing a relatively high cross-polarization isolation characteristic.

In one embodiment, the radiator is provided as a broadband droopy bowtie turnstile radiator provided from a dielectric support (e.g. provided from Teflon® or Arlon®) and an upper coating, made of the same material as the support. The radiator may be manufactured using relatively low-cost manufacturing techniques such as injection molding techniques although other manufacturing techniques, may of course, also be used. When a scan element pattern is optimized by appropriately selecting radiator dimensions the droopy bowtie turnstile has a highly-uniform scan element pattern and a wide scan impedance bandwidth, which covers elevation scan angles up to sixty degrees from zenith and all azimuth scan angles, uniformly over the X-band frequency range.

In one embodiment, the radiator may be provided using an injection-molding technique and thus the radiator may be provided as a low-cost radiator. Such an element is suitable for use in an array.

In one embodiment, a quad vertical feeding line made out of four individual transmission lines disposed around a common ground conductor column feeds a radiator. In one embodiment, the ground conductor column is provided as a solid column having a rectangular or square cross-sectional shape. In some applications, a solid conductor may be preferred for mechanical purposes, but in other applications, a hollow or partially hollow conductor could also be used. The use of individual transmission lines provides the balun having a relatively high cross-polarization isolation characteristic and is easily manufactured using commercially available materials. The same quad line can be used for S-, C-, and X-band frequency ranges, without changing balun parameters (i.e. without changing the cross-sectional dimensions of the quad vertical feeding line). The balun is mechanically stable which facilitates attachment to a PCB on one end, and to a radiator on the other end. The balun also provides coincident phase centers for orthogonal disposed dipoles, and provides flexibility in choosing an array lattice geometry (rectangular, triangular, etc.).

In one embodiment, a quad line vertical balun column includes a central member provided from a conductive material which acts as a ground plane and four transmission lines sharing the same ground plane. A first dielectric slab (or sheet) has a first surface disposed over a first conductive surface of the conductive member. A second opposing surface of the first dielectric slab has a conductor disposed thereon. A second dielectric slab has a first surface disposed over a second conductive surface of the conductive member and a second opposing surface of the second dielectric slab has a conductor disposed thereon. A third dielectric slab has a first surface disposed over a third conductive surface of the conductive member and a second opposing surface of the third dielectric slab has a conductor disposed thereon. A fourth dielectric slab has a first surface disposed over a fourth conductive surface of the conductive member and a second opposing surface of the fourth dielectric slab has conductor disposed thereon. If the central member is provided having a square cross-sectional shape, then the quad line vertical balun column can provide coincident phase centers to orthogonal polarizations while at the same time having a relatively high isolation characteristic between each of the transmission lines.

BRIEF DESCRIPTION OF THE DRAWINGS

The foregoing features of this invention, as well as the invention itself, may be more fully understood from the following description of the drawings in which.

Figure 1:
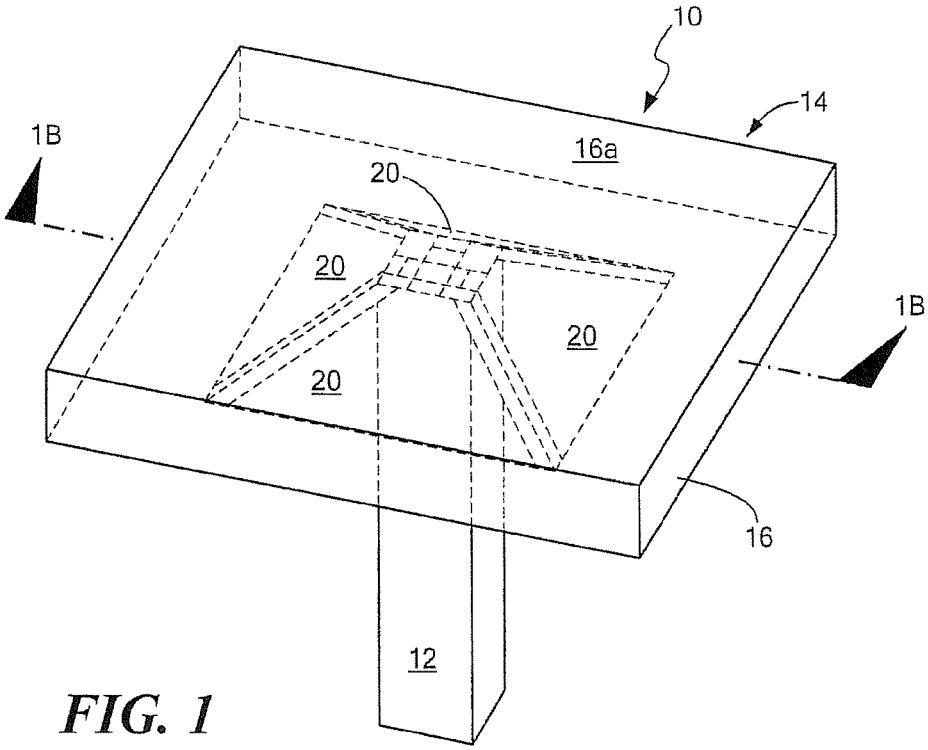
FIG. 1 is an isometric view of a droopy bowtie turnstile antenna element.

It should be understood that in an effort to promote clarity in the drawings and the text, the drawings are not necessarily to scale, emphasis instead is generally placed upon illustrating the principles of the invention.

DESCRIPTION OF THE PREFERRED EMBODIMENTS

Before describing the various embodiments of the circuits, systems and techniques described herein, some introductory concepts and terminology are explained.

Reference is sometimes made herein to a quad line balun column coupled to an antenna element of a particular type, size and/or shape. For example, one type of antenna element is a so-called droopy bowtie turnstile antenna element having a size and shape compatible with operation at a particular frequency (e.g. 10 GHz) or over a particular range of frequencies (e.g. the C, S, L and/or X-band frequency ranges). Those of ordinary skill in the art will recognize, of course, that other shapes and types of antenna elements (e.g. an antenna element other than a droopy bowtie antenna element) may also be used with a quad line balun column and that the size of one or more antenna elements may be selected for operation at any frequency in the RF frequency range (e.g. any frequency in the range of about 1 GHz to about 100 GHz). The types of radiating elements which may be used with a quad line balun column (e.g. to form an array) include but are not limited to bowties, notch elements, dipoles, slots or any other antenna element (regardless of whether the element is a printed circuit element) known to those of ordinary skill in the art.

It should also be appreciated that the embodiments involving an array, the antenna elements in the-array can be provided having any one of a plurality of different antenna element lattice arrangements including periodic lattice arrangements (or configurations) such as rectangular, square, triangular (e.g. equilateral or isosceles triangular), and spiral configurations as well as non-periodic or arbitrary lattice arrangements.

Applications in which at least some embodiments of the balun and/or droopy bowtie antenna element described herein may be used include, but are not limited to: radar, electronic warfare (EW) and communication systems for a wide variety of applications including ship based, airborne, missile and satellite applications.

As will also be explained further herein, at least some embodiments of an integrated balun and droopy bowtie antenna element are applicable, but not limited to, military, airborne, shipborne, communications, unmanned aerial vehicles (UAV) and/or commercial wireless applications.

Figure 1A:
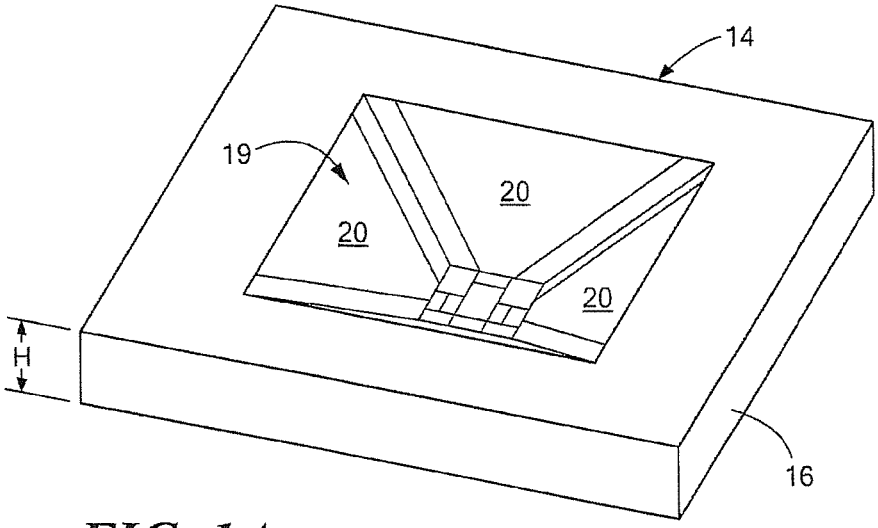
FIG. 1A is an inverted isometric view of the droopy bowtie turnstile antenna element of FIG. 1.
Figure 1B:
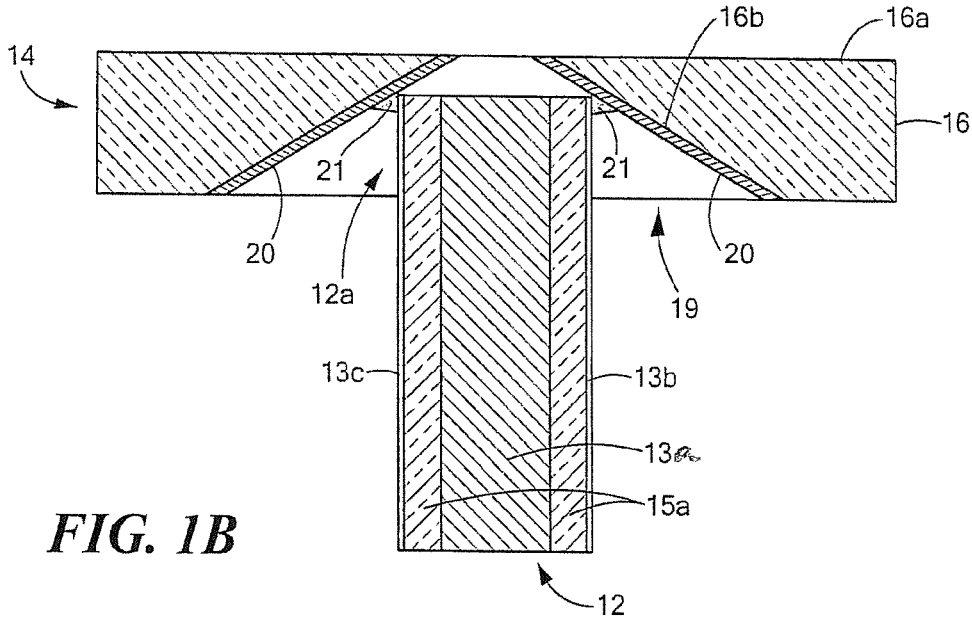
FIG. 1B is a cross-sectional view the droopy bowtie turnstile antenna element taken across lines 1B-1B in FIG. 1.

Referring now to FIGS. 1-1B in which like structures are provided having like reference designations throughout the several views, an integrated antenna element 10 includes a quad line balun column 12 (or more simply balun 12) having a first end electrically coupled to a feed point of a droopy-bowtie turnstile antenna element 14 (also sometime referred to simply as element 14). Since balun 12 is coupled to the center of element 14, the element is also sometimes referred to as a center-fed droopy-bowtie turnstile antenna element 14. Element 14 comprises a radiator block 16, which may be provided as a block of dielectric such as Teflon® for example. Radiator block 16 has a first surface 16*a* and a second surface 16*b*. After reading the description herein, those of ordinary skill in the art will appreciate how to select a material from which radiator block 16 may be provided.

As can be most clearly seen in FIG. 1A, radiator block 16 has height H and is turned upside-down in FIG. 1A in order to reveal a cavity 19 formed in surface 16*b* of radiator block 16. In this exemplary embodiment, cavity 19 is provided having a pyramidal shape. Conductive material is disposed or otherwise provided (e.g. via patterning techniques, deposition techniques or any subtractive or additive techniques known to those of ordinary skill in the art) on those portions of radiator block surface 16*b* which form cavity 19 to form radiators 20 for element 14.

As can also be clearly seen in FIG. 1A, radiators 20 in radiator block 16 are provided as four surface-plated metal wings within pyramidal-shaped cavity 19 provided in radiator block 16. Each structure 16, 20 can be injection-molded and then secured together (e.g. by epoxy) although techniques other than injection molding techniques may also be used to provide structures 16, 20. In some embodiments, structures 16, 20 may be provided as a single piece of dielectric.

As described above, radiator block 16 is provided having a pyramidal-shaped cavity 19 provided therein and radiators 20 are formed on a surface of block 16 which define the pyramidal-shaped cavity 19. In an alternate embodiment, a dielectric substrate having a pyramidal shape may be used (i.e. rather than providing structure 16 having a block-shape, structure 16 is provided having a pyramidal shape). In this case, four surface-plated metal wings would be provided on the external pyramidal surfaces.

It should, however, be appreciated that the use of a cavity (e.g. cavity 19 as illustrated in FIGS. 1-1B) allows a dielectric protection layer 16*a* to be disposed over radiators 20. Such a dielectric protection layer is desirable since it suppresses surface waves in an array and potentially increases the non-blindness region of operation.

Referring now to FIG. 1B, one end 12*a* of balun column 12 is coupled to the conductive material which form radiators 20 (only two radiators 20 visible in FIG. 1B). In one embodiment, column 12 is coupled to radiators 20 via a solder connection 21. Those of ordinary skill in the art will appreciate, of course, that techniques other than soldering may also be used to couple balun 12 to radiators 20. Such techniques, include but are not limited to welding techniques, and conductive epoxy techniques.

Figure 2:
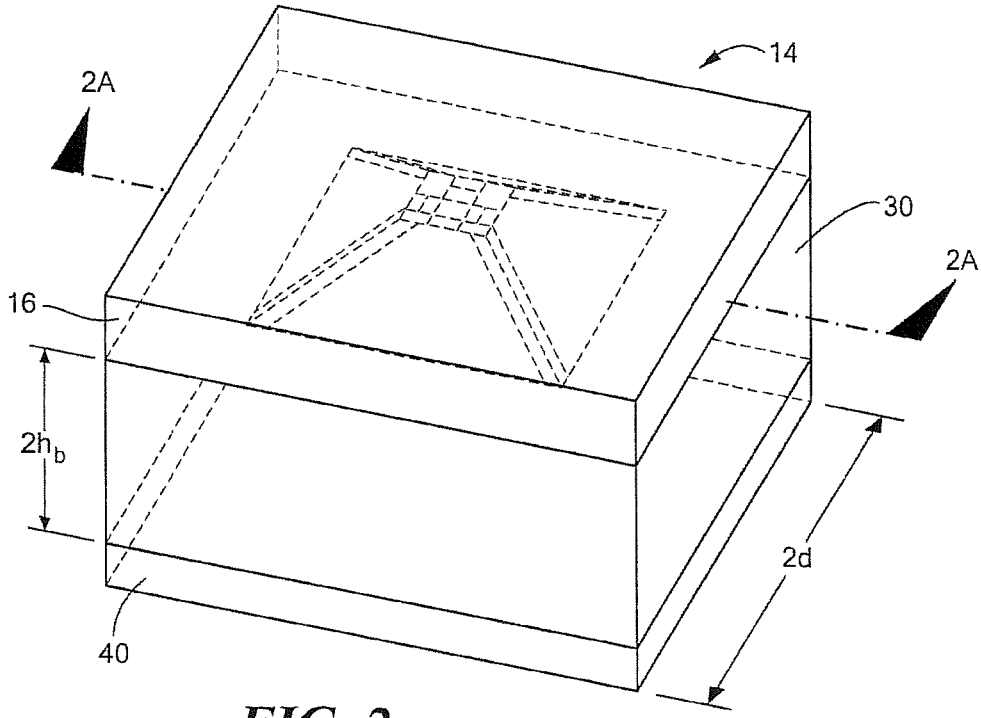
FIG. 2 is an isometric perspective view of a droopy bowtie antenna element unit cell comprised of a quad line balun column coupled to a droopy bowtie turnstile antenna element, a support block and a feed circuit.

Referring now to FIG. 2, radiator block 16 is disposed over a dielectric support structure 30 of height $2h_b$ and having sides of length $2d$. In one embodiment, radiator block 16 and support structure 30 are provided from Teflon® and support 30 is provided as a solid Teflon® brick to which radiator block 16 and thus bow-tie wings are attached for support.

Figure 2A:
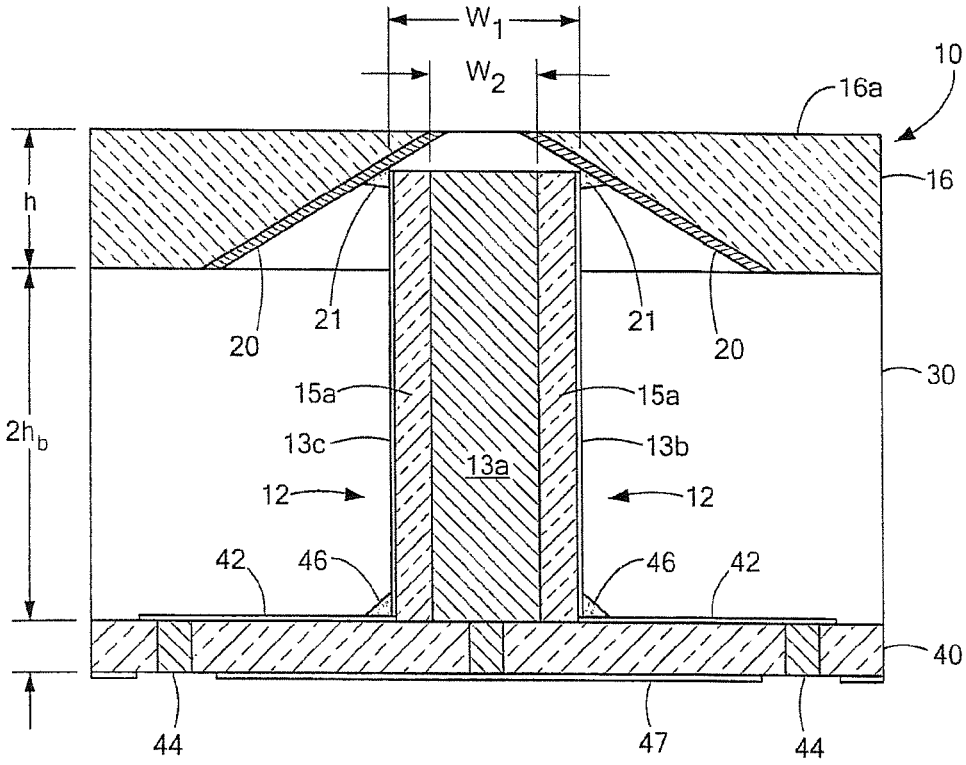
FIG. 2A is a cross-sectional view of the droopy bowtie antenna element unit cell taken across lines 2A-2A in FIG. 2.

Referring now to FIG. 2A in which like structures of FIGS. 1-2 are provided having like reference designations, integrated antenna element 10 is disposed over support block 30 which in turn is disposed over a printed circuit board 40.

Balun column 12 has a first end electrically and mechanically coupled to radiators 20 and a second end electrically and mechanically coupled to conductors 42 disposed on circuit board 40. Conductors 42, in turn, are coupled to other circuits (not shown on FIG. 2A), here through via holes 44 for example. In one embodiment, second end of column 12 is coupled to conductors 42 via solder connections 46. Circuit board 40 has a ground plane 47 disposed over a second surface thereof.

Column 12 includes a plurality of, here four, dielectric substrates 15*a*-15*d* (only one dielectric substrate 15*a* being visible in FIG. 2A) with each substrate 15*a*-15*d* having conductors 13*a*-13*d* (only conductors 13*a*-13*c* visible in FIG. 2A) disposed thereon with each of the conductors 13*a*-13*d* having a first end coupled to a corresponding one of four radiators 20 and a second end coupled to a conductor 42 on PCB 40. In one particular embodiment, conductors 13*a*-13*d* are provided having a width equal to the width of the respective substrates 14*a*-14*d* on which they are disposed. In other embodiments, the width of conductors 13*a*-13*d* is less than the width of the respective substrates. In general, the width of conductors 13*a*-13*d* are selected to provide a desired impedance characteristic.

In FIG. 2A, a proposed balun connection to the droopy bowtie turnstile radiator described above in conjunction with FIGS. 1-1B is shown. In some embodiments, it may be desirable to allow for an overlap between the wings 20 and the outer copper of transmission lines, in particular, for better soldering joints. If necessary, this overlap can be reduced by widening the antenna feed area $W_2$ in FIG. 2A or by reducing the balun size (e.g., the cross-sectional area of the balun), or by other means. However, its effect may useful, from the viewpoint of a potential simple tuning mechanism. Thus, FIG. 2A illustrates an exemplary balun-to-radiator and balun-to-PCB assembly for use in a variety of frequency ranges including, but not limited to, the X-band frequency range.

Figure 3:
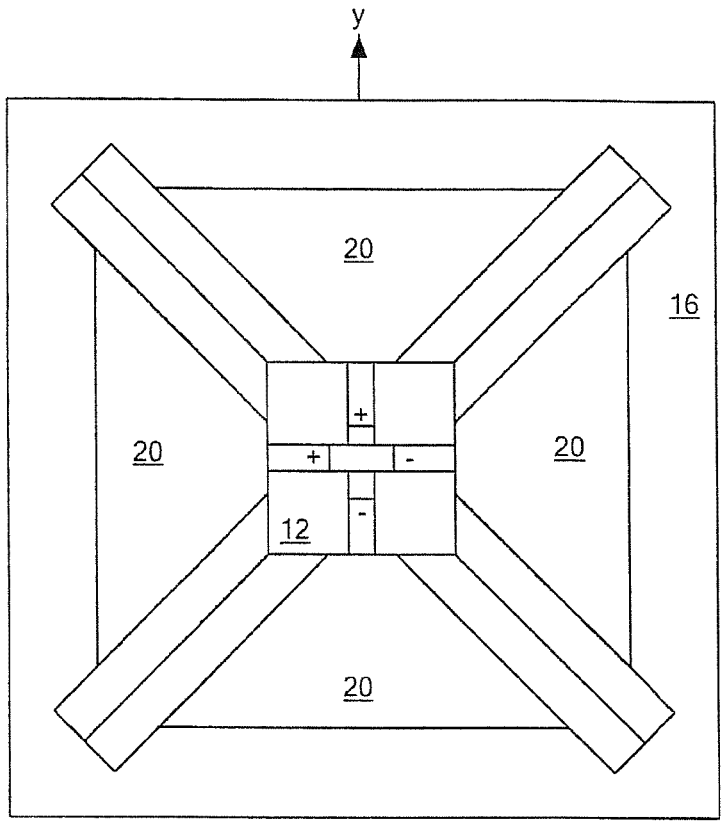
FIG. 3 is a top view of a droopy bowtie antenna element.
Figure 4:
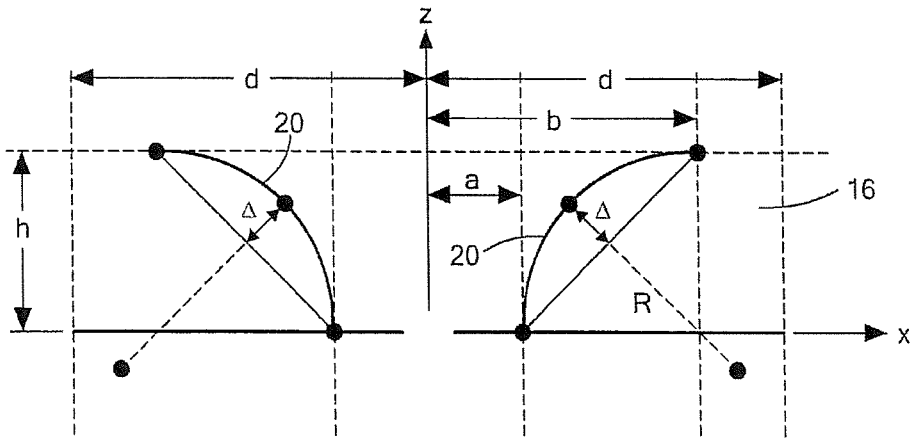
FIG. 4 is a side view of a droopy bowtie antenna element.

FIGS. 3 and 4 and Table 1 show a geometry of an exemplary antenna element 14 which may be of the type described above in conjunction with FIGS. 1-2A. As illustrated in FIG. 4, a convexity factor, Δ, controls the shape of wings 20. Thus, changing the convexity factor changes the wing shape from a convex shape, to a straight shape, to a concave shape.

Table 1 lists the dimensions of an array element optimized for operation in the X-band frequency range. The corresponding geometry parameters are labeled in FIG. 3 and FIG. 4, respectively. One can see that the unit cell size (defined as 2*d* in FIG. 4) is chosen as 10.9 mm, which is slightly less than a free-space half-wavelength, λ/2=12.5 mm, at the upper band frequency f=12 GHz. The total element height from the ground plane 47 (FIG. 2A) to the top of the upper Teflon cover is 5.45 mm.

TABLE 1

| Quantity | Value | Meaning |
|---|---|---|
| a | 0.9 mm | Feed half-width |
| b | 3.25 mm | Radiator half-width |
| d | 5.45 mm | Unit cell half-size |
| h | 1.45 mm | Height of the radiator top (droopiness factor) |
| Δ | Varies from 0.2 mm to −0.2 mm | Convexity factor |
| $2h_b$ | 4 mm | Height of antenna support in FIG. 1b. |
| $W_1$ | 3.02 mm | Width of dielectric substrate |
| $W_2$ | 1.75 mm | Width of conductor |

The convexity factor may typically vary from about 0.2 mm to about −0.2 mm for operation in the X-band frequency range. Such a variation usually has a minor effect on the antenna impedance characteristics but, at the same time, it provides acceptable mechanical tolerances to be established for antenna manufacturing. Convexity also provides another design parameter that can be used to optimize element pattern performance with respect to bandwidth. It should, however, be appreciated that regardless of the convexity factor setting, droopy—bowtie performance is toleranced to variations in this factor which make it amenable to established manufacturing processes.

Figure 5:
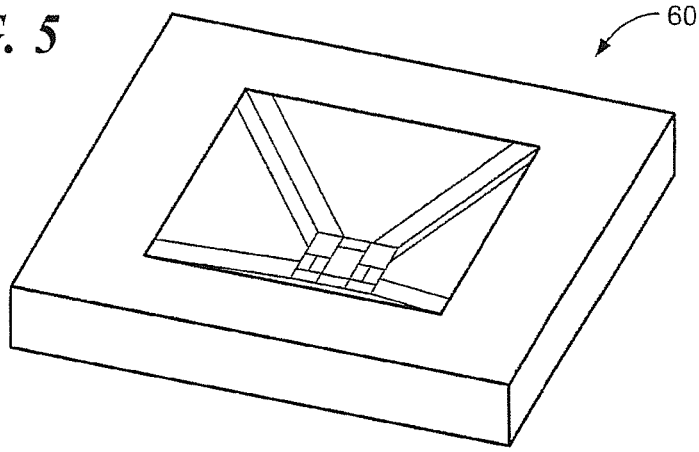
FIGS. 5-5B are a series of perspective views of droopy bowtie antenna elements having different convexity factors.
Figure 5A:
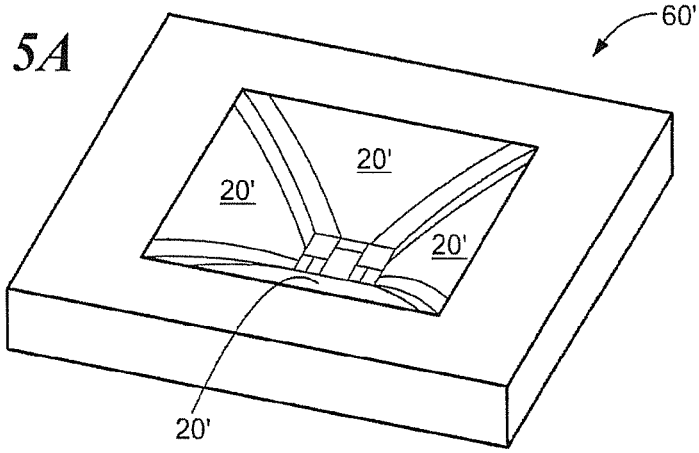
Figure 5B:
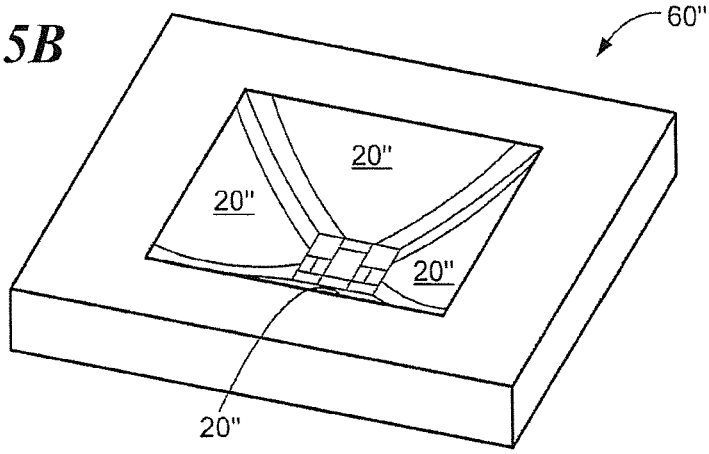

Referring now to FIGS. 5-5B, a droopy bowtie turnstile element 60 (FIG. 5) has a convexity factor (Δ) set equal to zero. Thus, element 60 (FIG. 5) is said to be non-convex. Element 60' in FIG. 5A is provided having a convexity factor (Δ) set equal to 0.06. Thus, element 60' is said to have radiators (or wings) 20' with a positive convexity. Element 60" in FIG. 5B is provided having a convexity factor (Δ) set equal to −0.06. Thus, element 60" is said to have radiators 20" with a negative convexity.

Figure 6:
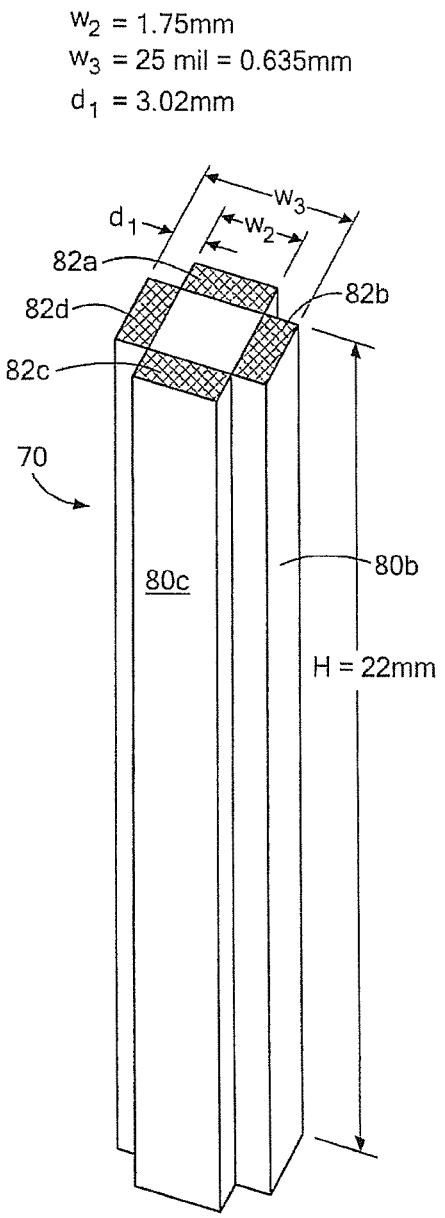
FIGS. 6-6B are a series of isometric views of quad line balun columns for use in different frequency bands.
Figure 6A:
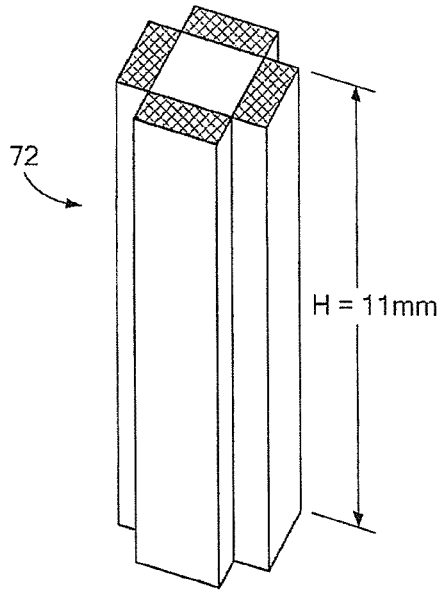
FIG. 6C is an end view of a quad line balun.
FIG. 6D is an end view of an alternate embodiment of a quad line balun.
Figure 6B:
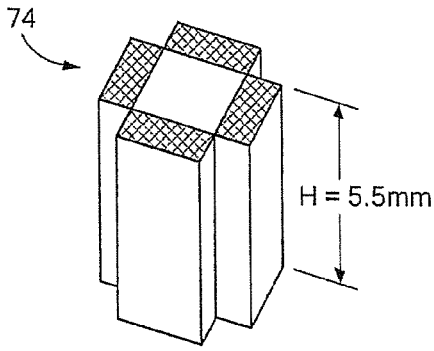

Referring now to FIGS. 6-6B, quad line balun columns 70, 72, 74 for operation in the S-band (FIG. 6), C-band (FIG. 6A) and X-band (FIG. 6B) frequency ranges, respectively, are shown. It should be appreciated that balun columns 70, 72, 74 are the same as or similar to balun column 12 described above in conjunction with FIGS. 1-2B. Thus, balun columns 70, 72, 74 provide a higher isolation between two turnstile antenna elements than prior art baluns or feeds since two pairs of feeding transmission lines are shielded. The shielding is due to the use of bulky central conductor (78), high dielectric constant material (82*a*-*d*) as well as the lines being isolated by the air-gaps. Moreover, the phase center of two crossed dipoles remains the same.

Figure 6C:
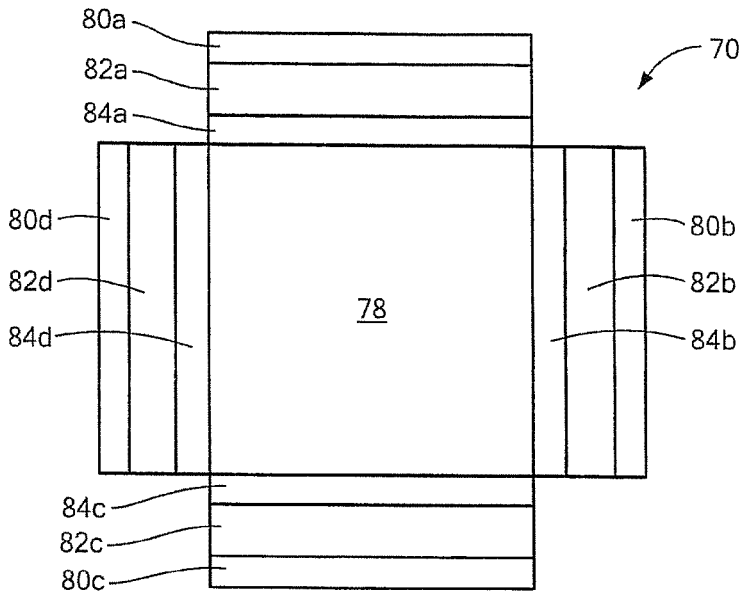

Referring now to FIG. 6C, and taking quad line balun column 70 as representative of quad line balun columns 72, 74, an end view of a balun column 70 reveals a central member 78 having a square cross-sectional shape. Dielectric substrates 82*a*-82*d* are disposed over external surfaces of central member 78. In the embodiment shown in FIG. 6C, dielectric substrates 82*a*-82*d* are each provided having conductive material 80*a*-80*d* and 84*a*-84*d* disposed on opposing surfaces thereof. Substrates 82*a*-82*d* may be secured to central member 78 using glue, epoxy, welding or any other fastening technique well-known to those of ordinary skill in the art. It should be appreciated that is some embodiments, it may be desirable or necessary to omit conductors 80*a*-80*d* in which case a surface of dielectric materials 82*a*-82*d* would be disposed against external surfaces of central member 78 (e.g., using glue, epoxy of other fastening techniques known to those of ordinary skill in the art). It should also be appreciated that balun column 70 may be the same as or similar to balun column 12 (FIGS. 1-2B) in which case conductors 80*a*-80*d* may correspond to conductors 13*a*-13*d* shown in FIGS. 1-2A.

In the embodiment of FIG. 6C, balun column 70 includes conductors 80*a*-80*d* having a width substantially equal to the width of the respective dielectric substrates 82*a*-82*d* on which the conductors 80*a*-80*d* are disposed.

Figure 6D:
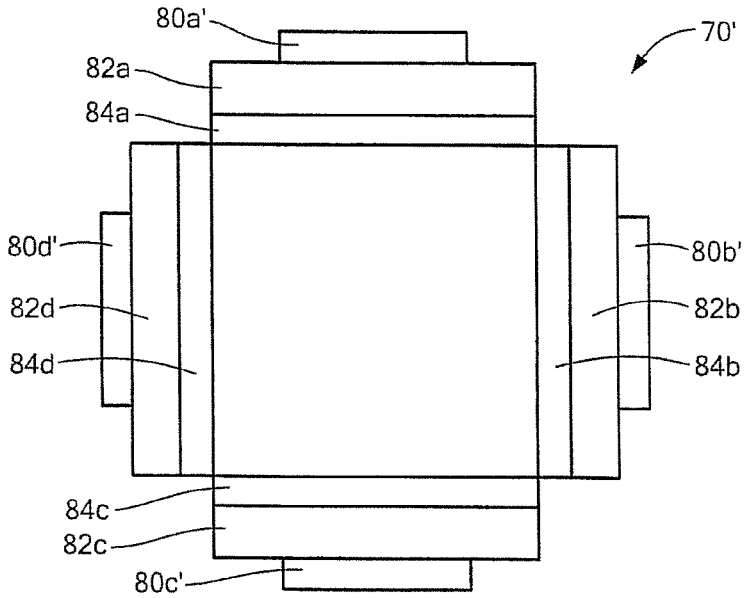

Referring now to FIG. 6D, balun column 70' is similar to balun column 70 in FIG. 6C except that conductors 80*a*'-80*d*' are each provided having a width which is less than the width of the respective dielectric substrates 82*a*-82*d* on which it is disposed.

All baluns in FIGS. 6-6B may be provided having the same transversal dimensions and use the same dielectric material (e.g. Rogers RT/duroid 6010 with 25 mil thickness). Also, baluns 70-74 may be provided having the same characteristic impedance of about 30 Ohm per port, assuming differential feeding.

One straightforward prior art realization of a Dyson balun for the droopy bowtie radiators involves the use of four coaxial cables. Such an approach is inconvenient for the X-band, since it is difficult to attach the cables to a printed circuit at one end and to antenna wings of the droopy bowtie at the other end.

Thus, to realize the Dyson balun in accordance with the structures and techniques described herein, a vertical rectangular transmission line referred to herein as a quad line is used. The quad line includes: a central conductive member; and (b) four adjacent microstrip transmission lines sharing the same ground provided by the central conductive member (i.e. each disposed on side surfaces of the central conductive member). In one embodiment, the central conductive member is provided having a square or rectangular cross-sectional shape and is provided as a solid metal conductor (e.g. a copper or brass bar). In other embodiments, the central conductive member need not be solid (e.g. it could be hollow or partially hollow). Also, the central conductive member may be provided from a nonconductive material and have a conductive coating or a conductive surface disposed thereover to provide a central conductive member.

In one embodiment, the central conductive member is provided from a machining technique. In other embodiments, the conductive member may be formed via a molding technique (e.g. injection molding). Other techniques known to those of ordinary skill in the art may also be used to provide a central conductive member.

In one exemplary embodiment, the quad line balun includes microstrip transmission lines provided from Rogers RT/duroid 6010 PTFE ceramic laminate having a relative dielectric constant ($\in_r$) in the range of about 10.2 to about 10.9 and a loss tangent of about 0.0023. The laminate is provided having a conductive material disposed on opposing surfaces thereof. The conductive material may be provided as rolled copper or electrodeposited (ED) copper, for example. The transmission lines are cut, etched or otherwise provided from a dielectric sheet, as double-sided strips, and then coupled to a central conductive member using a soldering technique or other suitable attachment technique.

Such a balun construction results in two transmission line pairs which are highly isolated (in the electrical sense) and which are appropriate for feeding two antennas. This is due to the bulky central conductor and a high-dielectric constant dielectric material used for line filling; furthermore, the lines are isolated by air gaps.

As illustrated in FIGS. 6-6B, all balun transmission lines shown in FIGS. 6-6B have the same dimensions (excepting length) and the same characteristic impedance of about 30 Ohms per port, assuming that opposite ports (e.g. ports 1 and 3, or 2 and 4) are fed out of phase by 180 deg. This means a 60 Ohm impedance per one dipole antenna that is fed with two ports in series, which should provide a good impedance match to a bowtie radiator such as that discussed in conjunction with FIGS. 1-5B above. Moreover, a balun constructed as described is suitable for operation over the S-, C- and X-band frequency ranges, without changing balun dimensions (excepting length).

Figure 7:
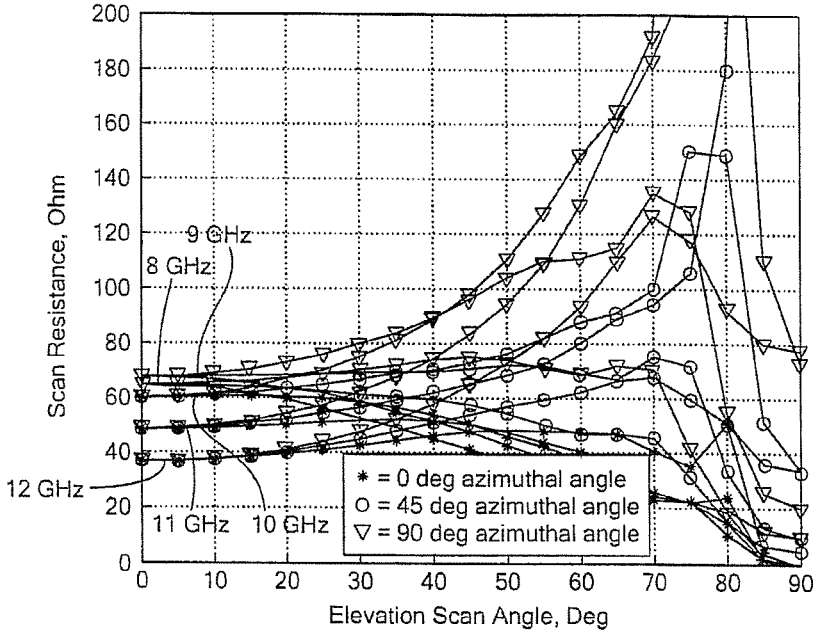
FIG. 7 is a plot of scan resistance (in ohms) vs. elevation scan angle (in degrees)
Figure 7A:
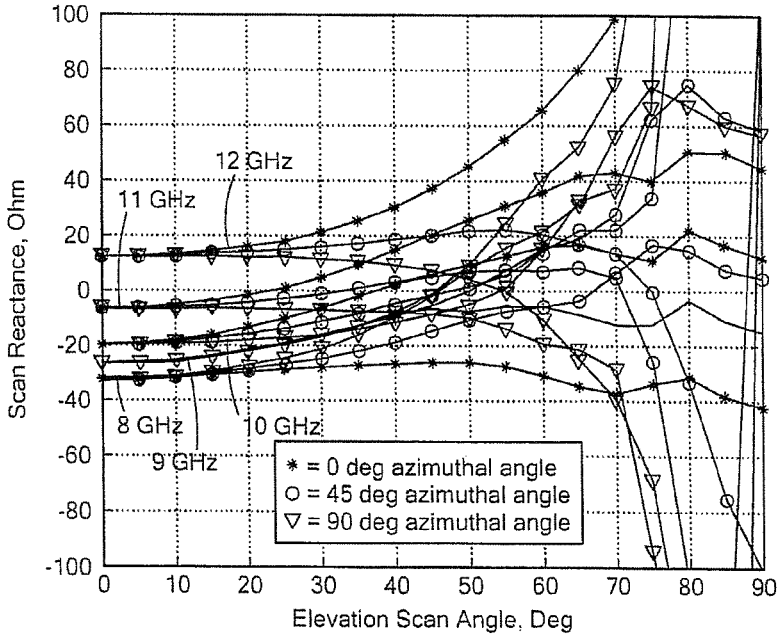
FIG. 7A is a plot of scan reactance (in ohms) vs. elevation scan angle (in degrees)

Referring now to FIGS. 7-7A, these figures show the scan impedance for an element of the type described above in conjunction with FIGS. 1-1B of an infinite array with the parameters from Table 1. The convexity factor is zero. The scan impedance was found using the unit-cell approach in Ansoft HFSS, with two parametric sweeps over two variable scan angles. An accurate FEM mesh was used (on the order of 25,000 tetrahedra assuring a good relative convergence), along with the discrete frequency sweep.

Figure 7B:
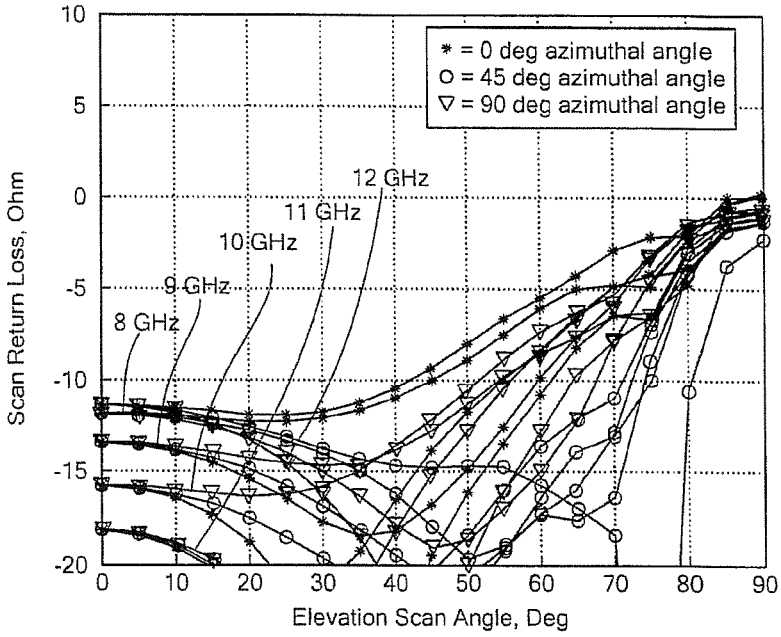
FIG. 7B is a plot of scan return loss (in dB) vs. elevation scan angle (in degrees)

FIG. 7 and FIG. 7A give the scan impedance of an array element (resistance and reactance) while FIG. 7B shows the corresponding scan return loss. The center-fed antenna is matched here to 60 Ohm.

The data for five frequencies over X-band (8, 9, 10, 11, and 12 GHz) and for three azimuth scan angles (0, 45, and 90 deg) is shown. Results for different azimuth scan angles are labeled by symbols *, ○, ∇, which correspond to scan angles $\phi$=0, 45, 90 deg.

One can see that scan return loss generally lies below −10 dB for elevation scan angles up to 50 degrees and approaches approximately −6 dB for elevation scan angle of exactly 60 degrees.

The present results also indicate acceptable mechanical tolerances for antenna manufacturing since the shape variation of about 0.2 mm (about 8 mil) should not have a significant effect on radiator performance.

It is believed that the present results can further be improved by a more careful parameter selection. Even in its present case, the droopy bowtie radiator has an octave bandwidth (i.e. exceed the relative bandwidth of entire X-band) at high-elevation scan angles, i.e. close to zenith.

Figure 8:
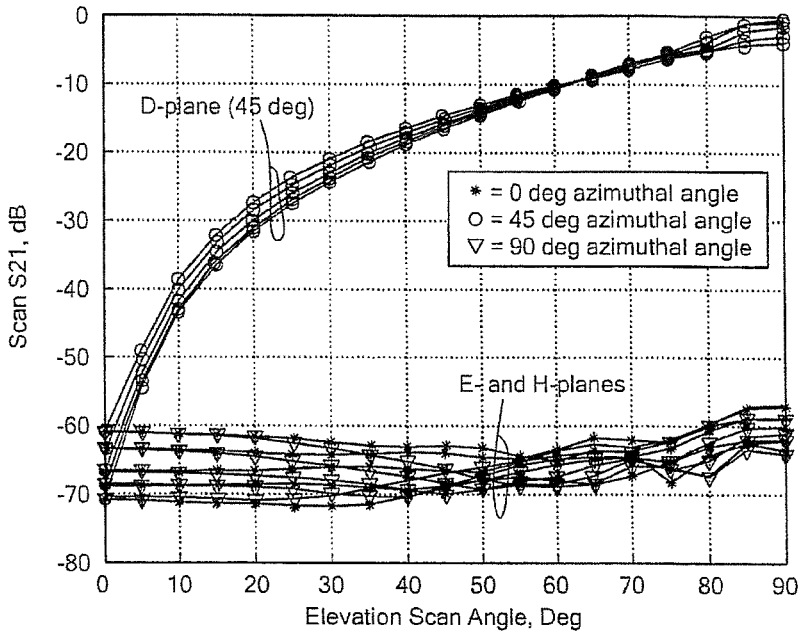
FIG. 8 is a plot of insertion loss (in dB) vs. elevation scan angle (in degrees)
Figure 8A:
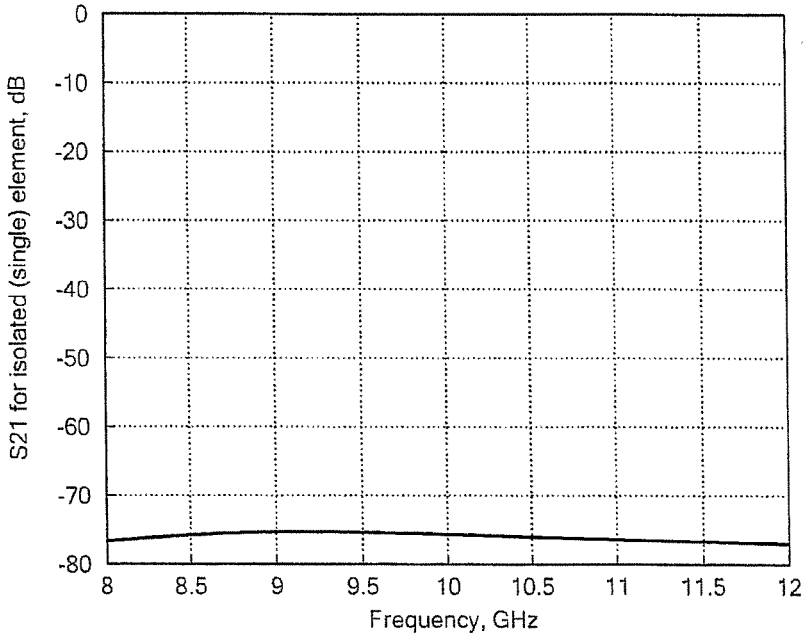
FIG. 8A is a plot of insertion loss (in dB) for an isolated single element vs. frequency (in GHz)

Referring now to FIGS. 8 and 8A, S parameter measurements for a droopy bowtie of the type described above in conjunction with FIGS. 1-5 are shown. FIG. 8A shows S21 (cross-polarization isolation in dB) for a turnstile element with two center-fed crossed bowtie dipoles in the array environment. Geometry parameters are those from Table 1. The convexity factor is zero. This figure is complementary to FIGS. 7-7B above for the array scan impedance and scan return loss S11; both of the figures have been obtained with the same analysis software (e.g. Ansoft HFSS).

On the other, hand FIG. 8A shows S21 for a turnstile element with two center-fed crossed bowtie dipoles considered as an isolated (single) element. Geometry parameters are again those from Table 1. The convexity factor is zero. This figure is complementary to FIG. 8 above for the isolated element impedance and S11; both of them have been obtained with the same analysis software (e.g. Ansoft HFSS).

One can clearly see from these plots that that weak cross-polarization isolation in the D-plane in FIG. 8 is solely the effect of mutual coupling for the turnstile antenna. It does not exist for the isolated element in FIG. 8A. This observation might be in contrast to some patch-antenna based phased arrays, where a low cross-polarization level is already observed for an isolated patch antenna element. This circumstance further makes the array cross-polarization even worse.

One can also see from FIG. 8 that the cross-polarization levels on the order of −25 dB are to be expected at $\theta_{scan}$=30 deg and of about −10 dB at $\theta_{scan}$=60 deg in the D-plane, for the present antenna design.

For the printed dipoles, the cross-polarization effect is mostly dominant in the D-plane (at 45 degree azimuth scan angle). Table 2 below gives some cross-polarization data for two arrays of printed dipoles in the D-plane.

Table 2 illustrates cross-polarization level for two arrays of printed dipoles in the D-plane. For comparison, the corresponding average cross-polarization level of the present antenna (e.g. as described in conjunction with FIGS. 1-5) is given in bold.

TABLE 2

| Elevation scan angle | 0 deg | 30 deg | 60 deg |
|---|---|---|---|
| Cross-polarization level Design #1 | ~−80 dB | ~−23.5 dB | ~−7.5 dB |
| | ~−65 dB | ~−23 dB | ~−10 dB |
| Cross-polarization level Design #2 | ~−22 dB | ~−22 dB | ~−13 dB |
| | ~−65 dB | ~−23 dB | ~−10 dB |

One can see that an array provided from droopy bowtie antenna elements generally follows the numerical (best-case) results for printed dipoles, despite the fact that it has a volumetric (3D) shape.

For bunny-ear dipoles, the cross-polarization effect is also mostly dominant in the D-plane (at 45 degree azimuth scan angle). Table 3 below gives some cross-polarization data for two arrays of printed dipoles in the D-plane.

Table 3 illustrates average cross-polarization level for a bunny-ear array in the three planes. For comparison, the corresponding average cross-polarization level of the turnstile bowtie antenna described herein is given in bold.

TABLE 3

| Elevation scan angle | 0 deg | 45 deg |
|---|---|---|
| Cross-polarization level-E-plane | ~−30 dB | ~−26.5 dB |
| | **~−65 dB** | **~−65 dB** |
| Cross-polarization level-H-plane | ~−25 dB | ~−22 dB |
| | **~−65 dB** | **~−65 dB** |
| Cross-polarization level-D-plane | ~−30 dB | ~−15 dB |
| | **~−65 dB** | **~−15 dB** |

One can see that the present design, at least theoretically, may outperform the bunny-ear array, for most cases. In the D-plane at lower elevation angles, the similar performance is observed. Indeed, the present antenna has a lower frequency bandwidth than the bunny-ear antenna.

The complete quad line is an eight-port network (four ports at each end).

Figure 9:
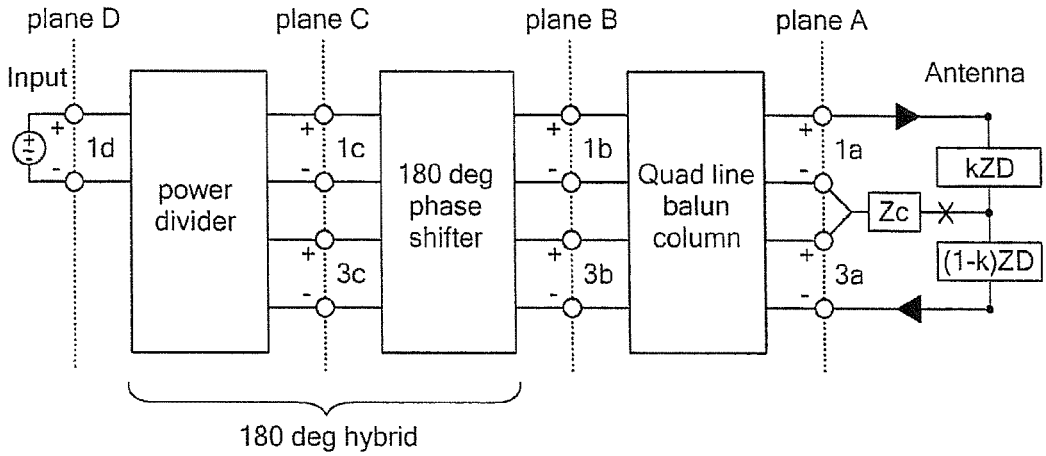
FIG. 9 is a block diagram of an antenna system utilizing a quad line balun column and a droopy bowtie antenna element.
Figure 10:
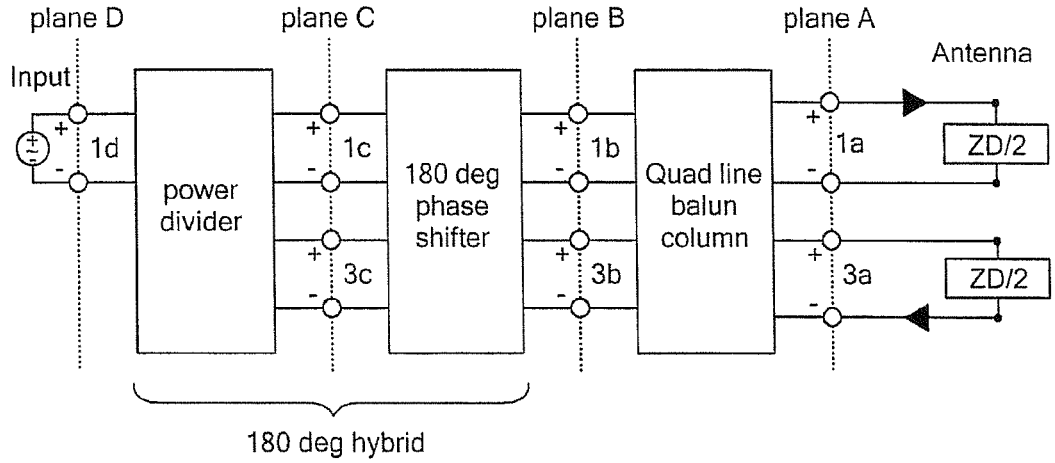
FIG. 10 is a block diagram of an antenna system utilizing a quad line balun column and a droopy bowtie antenna element.

Referring now to FIG. 9, three reference planes and three separate microwave network elements of the complete Dyson balun-based antenna radiator are shown. The feeding balun for only one antenna element is shown. For a symmetric antenna load with input impedance, $Z_D$, the antenna model in FIG. 9 simplifies as shown in FIG. 10. The block diagram of FIG. 10 shows how the entire model was simulated; the blocks representing the network elements were modeled and the resulting S-Parameter values were input to a matrix. Each S-parameter matrix file was then input to a Matlab script program and then multiplied (with appropriate phase shifts to represent the connecting transmission lines) to produce the overall impedance vs. frequency and return-loss vs. frequency plots.

Referring now to FIG. 10, a block diagram of a complete Dyson balun-based antenna radiator with a symmetric antenna load is shown. It should be noted that to promote clarity in the drawing, the balun for only one antenna element is shown It should be noted that using the delay line on one port (e.g. port 1*c* in FIG. 10) already introduces asymmetry into the setup. Such asymmetry may be taken into account via a power divider model.

The power divider may be provided as either a T-divider or a Wilkinson power divider.

The model of the quad line balun column is that of a transmission line with termination impedance $Z_T=Z_D/2$.

$$Z_{in} = Z_0 \frac{Z_T + jZ_0 \tan\beta L}{Z_0 + jZ_T \tan\beta L} \quad \text{Equation 1}$$

in which:

L is a length of the quad line balun length;

$Z_0$ is the characteristic impedance of the quad line balun;

$Z_T$ is the termination impedance of the quad line balun;

Similarly, the ratio of input voltage $V_{in}$ to output voltage $V_T$ of the quad line balun, is found from the ABCD matrix of a two-port network, in the form, $$\frac{V_{in}}{V_T} = \cos\beta L + j\frac{Z_0}{Z_T}\sin\beta L \quad \text{Equation 2}$$

For the phase shifter, a simple λ/2 delay line may be used, whose transmission line model is also given by Equations 1 and 2.

Figure 11:
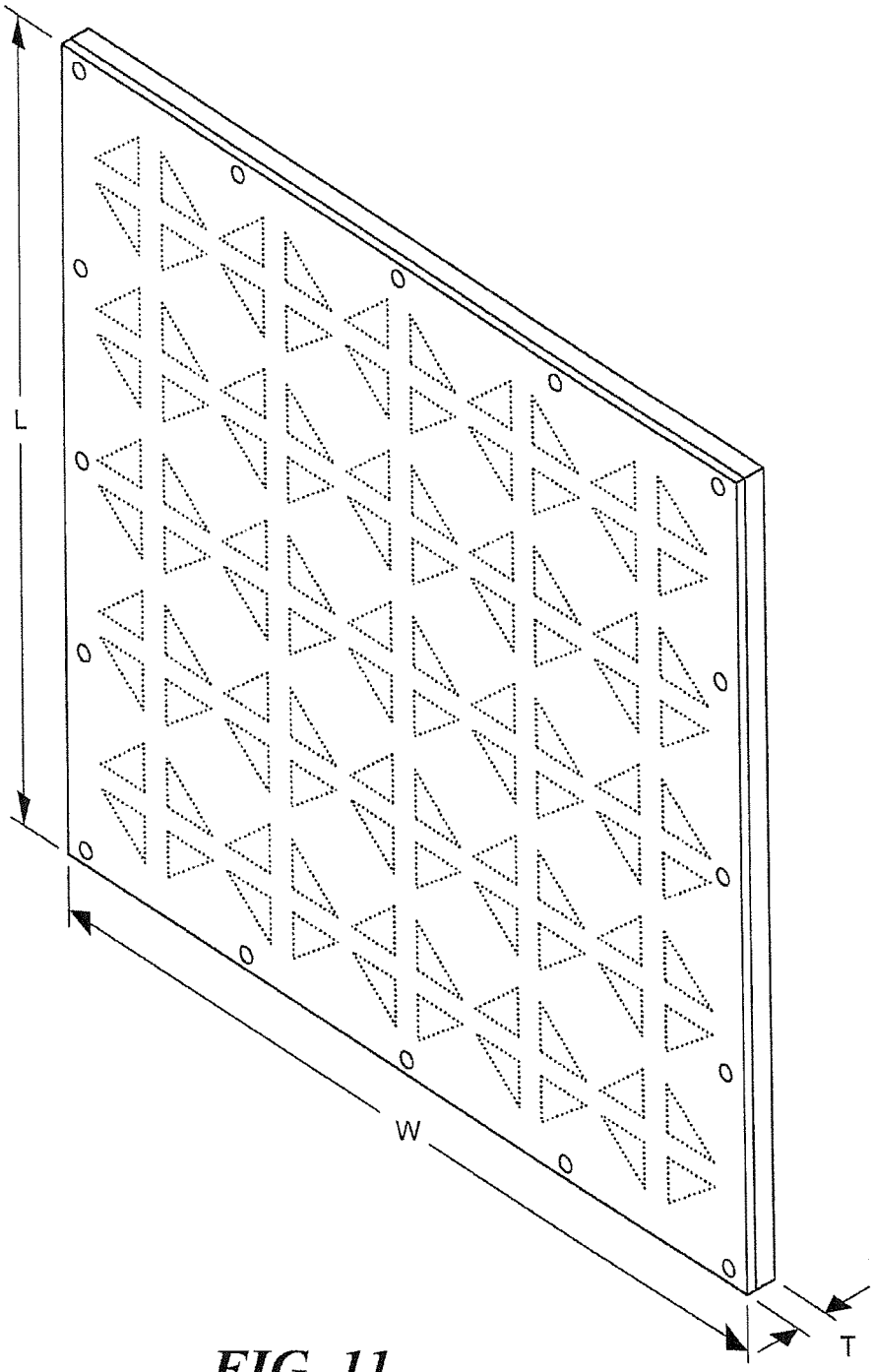
FIG. 11 is an isometric view of a panel array antenna comprised from a plurality of a droopy bowtie antenna elements.

Referring now to FIG. 11, a panel array includes a plurality of antenna elements with each of the elements corresponding to a turnstile bowtie antenna element of the type described above in conjunction with FIGS. 1-5. Each of the elements may be provided having a quad line vertical balun column (e.g. of the type described above in conjunction with FIGS. 6-6B) coupled thereto. In one embodiment, the panel array could be provided as a single injection mold of the bow-ties with supporting structure and the vertical balun column could be provided as a separate assembly placed into the opening in each unit cell. It should, of course, be appreciated that other fabrication and assembly techniques can also be used to provide an array.

Figure 12A:
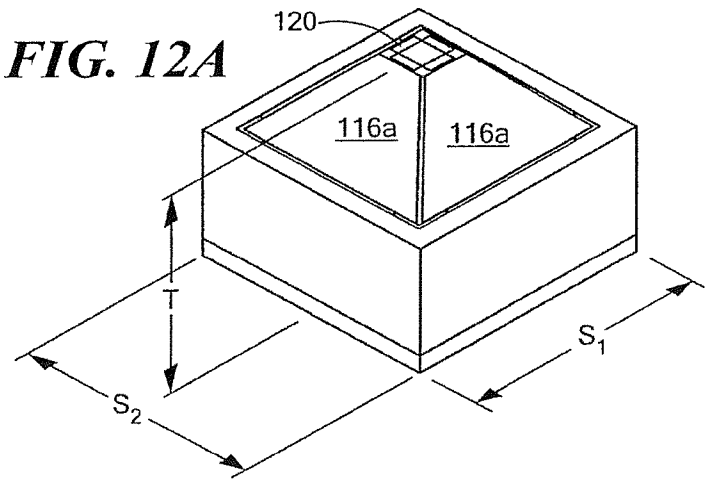
FIG. 12A is an assembled view of the droopy bowtie unit cell shown in FIG. 12.
Figure 12B:
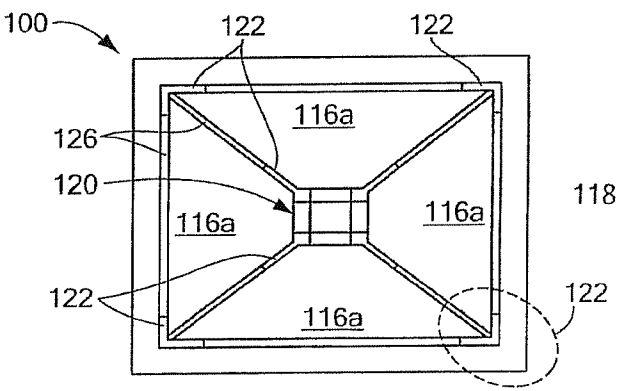
FIG. 12B is a top view of the droopy bowtie unit cell shown in FIG. 12A.
Figure 12:
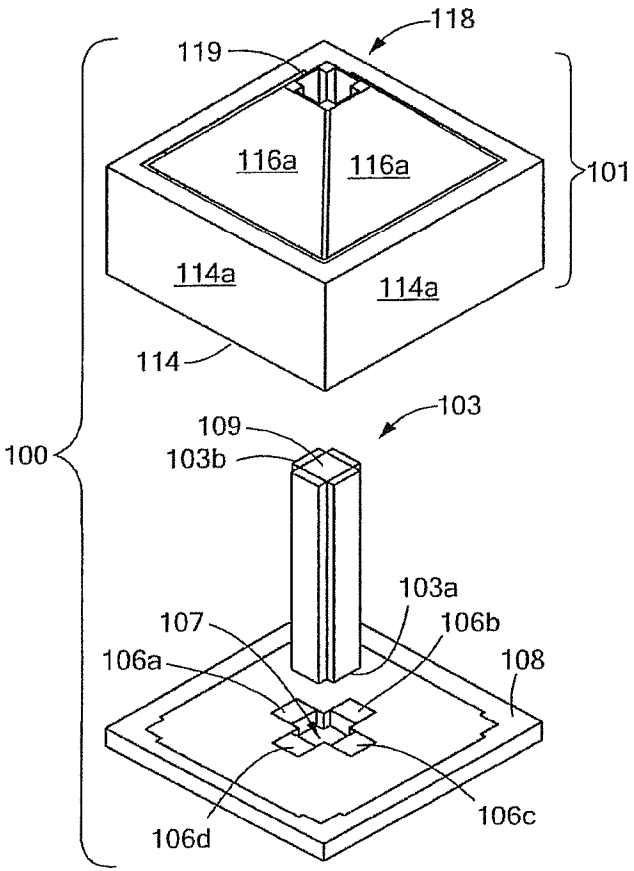
FIG. 12 is an exploded view of a single droopy bowtie unit cell.

Referring now to FIGS. 12-12B in which like elements are provided having like reference designations throughout the several views, a unit cell assembly 100 includes a radiator unit cell 101 disposed over a printed circuit board (PCB) base 102 with a balun 103 disposed to electrically couple radiator elements 116 of radiator unit cell 101 to RF circuitry (such as an RF distribution circuit, for example), provided as part of PCB base 102 (such RF circuitry not visible in FIGS. 12-12B).

Radiator unit cell 101 may be the same as or similar to antenna element 14 described above in conjunction with FIGS. 1-5B and comprises a radiator block 114 having conductive surfaces 114*a* (only two such surfaces 114*a* visible in FIGS. 12 and 12A). Conductive surfaces 114*a* form conductive walls (e.g. metalized walls) surrounding radiator unit cell 101. As will be described below in conjunction with FIGS. 13-15, when radiator unit cell 101 is provided as part of an antenna array, conductive surfaces 114*a* electrically isolate balun 103 and suppress surface wave mode coupling.

Radiator unit cell 101 also includes conductive surfaces 116*a* which correspond to droopy bowtie antenna elements 116 (only two such surfaces 116*a* visible in FIGS. 12 and 12A and four surfaces 116*a* visible in FIG. 12B). It should be appreciated that, although droopy bowtie elements 116 are here shown provided on external surfaces of radiator unit cell 101, one or all of the elements could be provided on an inside surface of radiator block 114 (e.g. in the manner shown in FIGS. 2 and 2A below).

Radiator unit cell 119 also includes a signal post receptor 119 which accepts balun end 103*b* and secures balun in opening 118. Radiator unit cell 101 also includes element supports 122 (most clearly visible in FIG. 12B) which correspond to non-conductive regions between bowtie elements 116.

Radiator elements 116 are also separated from each other and from conductive surface 114*b* of radiator block 114 by air gaps 126.

In one embodiment, radiator unit cell 101 or portions thereof is/are provided using injection molding techniques. Those of ordinary skill in the art will appreciate, of course, that other techniques may also be used to fabricate a radiator unit cell. When radiator unit cell 101 (or portions thereof) is/are provided via injection molding, an opening 118 may be formed during the injection molding process. Opening 118 is formed having a shape which accepts an end 103*b* of balun 103.

RF circuitry may be provided as part of PCB base 102 via a subtractive or an additive PCB manufacturing process. A conductor 108 is disposed around a perimeter of a first surface of the PCB base 102 and a plurality of RF pads 106*a*-106*d* are disposed over the first surface of PCB base 102 around a recess region 107 formed or otherwise provided in PCB 102. Recess 107 may extend entirely through base 102 (e.g. as a through hole) or may extend only partway into base 102. Recess 107 be provided in PCB base 102 via a machining operation (e.g. via a punching technique, a milling technique or via any other technique known to those of ordinary skill in the art).

Balun 103 has a first end 103*a* disposed in recess 107. Thus, in preferred embodiments at one end of balun 103 and recess 107 have complementary cross-sectional shapes such that the balun end mates with the recess. In some embodiments this may be a press fit such that balun securely fits in recess 107 and thus balun 103 mates with and projects from base 102. Balun 103 may the same as or similar to baluns described above in conjunction with FIGS. 1-2A, 6-6D, 9 and 10. Thus, recess 107 corresponds to a first means for securing balun 103 to base 102. It should, of course, be appreciated that other means, including but not limited to fasteners and brackets, may also be used to secure balun 103 to base 102.

A second end 103*b* of balun is coupled to radiator unit cell 101. As described above, radiator unit cell 101 is provided from conductive sidewalls 114 from which project a plurality of, here four, droopy bowtie radiators 116. A top portion of radiator unit cell 101 has an opening 118 provided therein through which the second end of balun 103 is disposed. Opening 118 includes surfaces 119 which form a shape complementary to a cross-sectional shape of the second end of balun 103 such that the second end of balun 103 mates with the recess 118 provided in the radiator until cell 101. Thus, recess 118 corresponds to a means for securing balun 103 to base 102. It should, of course, be appreciated that other means, including but not limited to fasteners and brackets, may also be used to secure balun 103 to base 102.

Balun 103 is electrically coupled to bowtie radiators 116. Such an electrical connection may be made, for example, using a solder reflow technique to form a conductive solder joint 120 (and thus an electrical connection) between the second end of balun 103 and the bowtie radiators 116.

In one embodiment, for operation in the x-band frequency range, unit cell 100 is provided having sides S1, S2 of equal width of 0.430 in., a thickness T of 0.220 in. Also, opening 118 has a size of 0.070 in×0.070 in. Given the above parameters, the size and shape of balun 103 and radiating elements 116 are selected to provide a described antenna operating characteristic.

Figure 13:
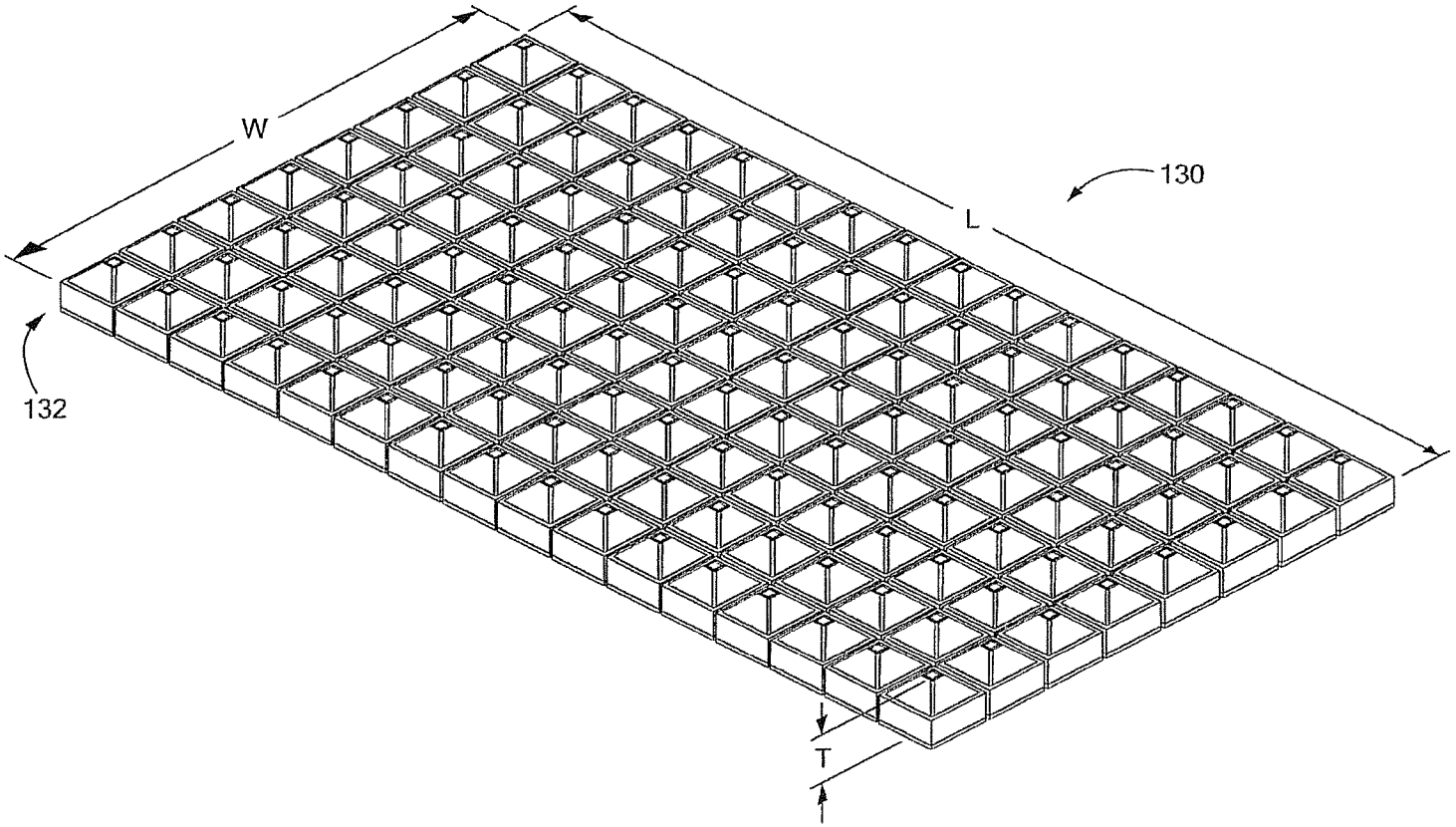
FIG. 13 is an isometric view of an array having a rectangular lattice and provided from a plurality of droopy bowtie unit cells.

Referring now to FIG. 13, an array antenna 130 (also sometimes referred to herein as an element array 130 or more simply array 130) comprises a plurality of unit cells 132, here one hundred twenty eight (128) unit cells arranged in a rectangular lattice shape. Each of unit cells 132 may be the same as or similar to unit cell 100 described above in conjunction with FIGS. 12-12B. Array 130 is provided having a length L, a width W and a thickness T. In one particular embodiment, for operation in the X-band frequency range array 130 is provided having eight (8) rows and sixteen (16) columns (8×16) and a 0.634×0.594 rectangular lattice which results in an array having a length L=9.53 in., a width W=5.06 in. and a thickness T=0.220 in. It should be appreciated that array 130 may be used as a subarray 130 in a larger array structure provided form a plurality of such subarrays 130.

Figure 14:
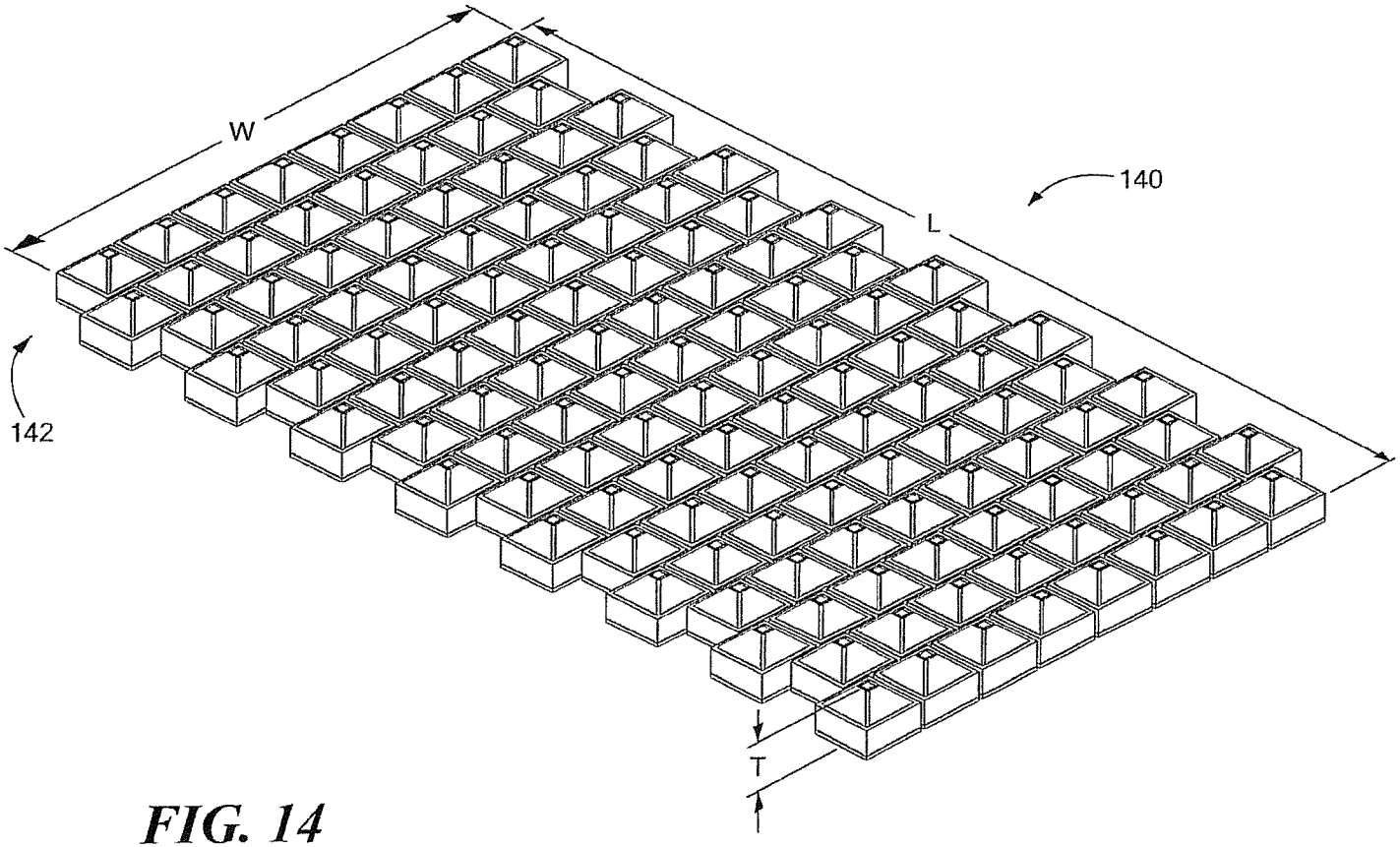
FIG. 14 is an isometric view of an array having a triangular lattice and provided from a plurality of droopy bowtie unit cells.

Referring now to FIG. 14, an array 140 comprises a plurality of unit cells 142, here one hundred twenty eight (128) unit cells, arranged in a triangular lattice. Each of unit cells 142 may be the same as or similar to unit cell 100 described above in conjunction with FIGS. 12-12B. In one particular embodiment, for operation in the X-band frequency range, array 140 is provided having eight (8) rows and sixteen (16) columns and a 0.680×0.590 unit cell shape which results in an array having a length L=9.68 in., a width W=5.70 in. and a thickness T=0.220 in. It should be appreciated that array 140 may be used as a subarray 140 in a larger array structure provided from a plurality of such subarrays 140.

Figure 15:
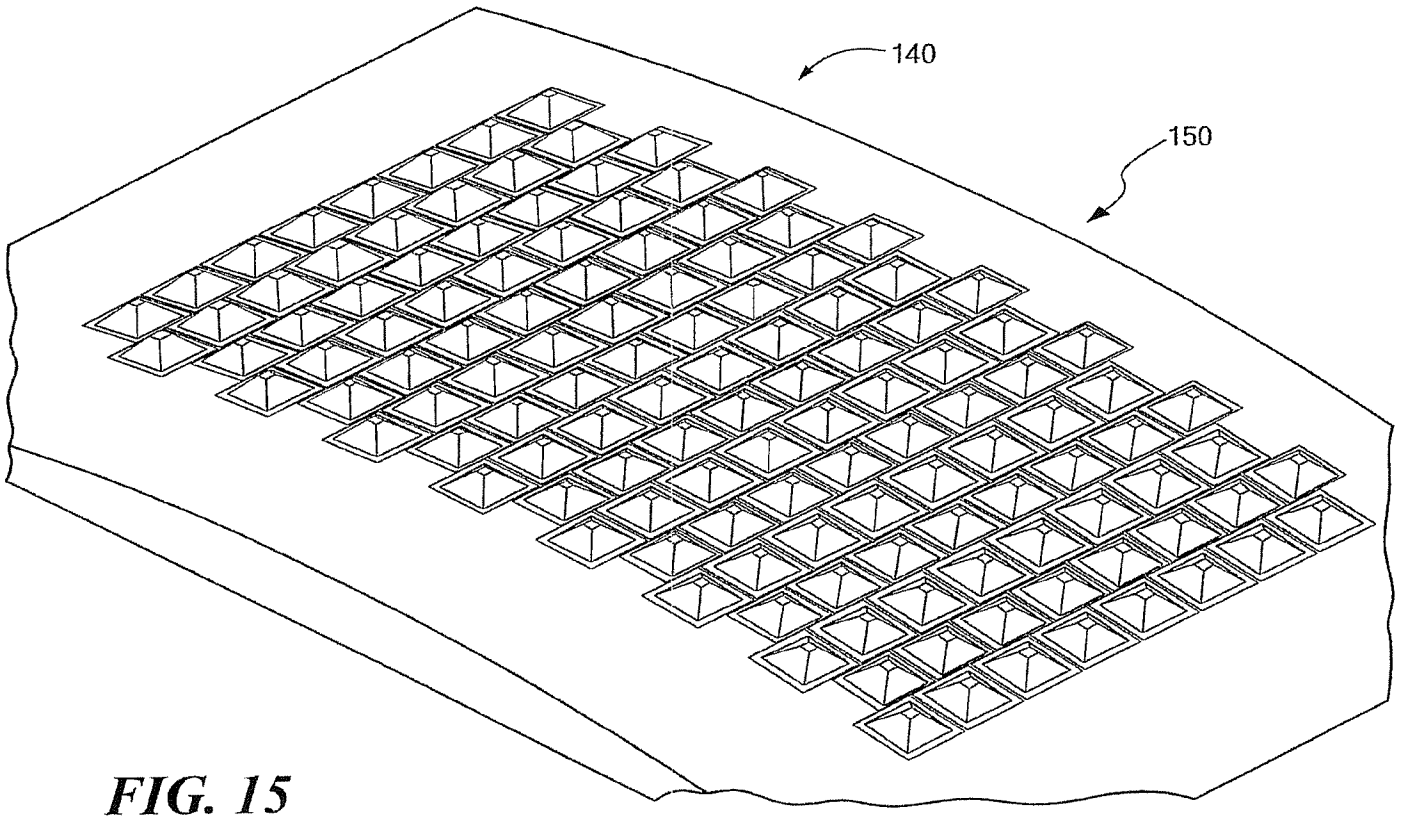
FIG. 15 is an is an isometric view of an array having a triangular lattice and provided from a plurality of droopy bowtie unit cells disposed on a conformal surface.

Referring now to FIG. 15, array 140 which may be similar to array 140 described above in conjunction with FIG. 14 is conformally disposed on a curved surface. Thus, FIG. 15 illustrates an array provided from one hundred twenty eight (128) unit cells disposed in a triangular lattice on a conformed surface.

It should, of course, be appreciated that although FIGS. 13-15 illustrate exemplary array shapes and array lattice geometries array shapes other than rectangular or substantially rectangular shapes could also be used. For example, circular, elliptical or other regular or even non-regular shapes may be used. It should also be appreciated that array geometries other than rectangular or triangular may also be used.

It should be noted that although the panel array is here shown having a square shape and a particular number of antenna elements, a panel or an array antenna having any array shape and/or physical size or any number of antenna elements may also be used. One of ordinary skill in the art will thus appreciate that the concepts, structures and techniques described herein are applicable to various sizes and shapes of panels and/or array antennas and that any number of antenna elements may be used.

Similarly, the concepts, structures and techniques described herein are applicable to various sizes and shapes of array antennas as well as to various sizes and shapes of panels (e.g. panels having particular geometric shapes including but not limited to square, rectangular, round or irregular shapes) as well as to particular lattice types or lattice spacings of antenna elements.

In view of the above description, it should now be appreciated that there exists a need to lower acquisition and life cycle costs of phased arrays while at the same time requirements for bandwidth, polarization diversity and reliability become increasingly more challenging. The balun and antenna element architecture and fabrication technique described herein offers a cost effective solution for fabrication of baluns and antenna elements (and phased arrays made from such baluns and antenna elements). Such baluns and antenna elements and phased arrays can be used in a wide variety of phased array radar missions or communication missions for ground, sea and airborne platforms.

All publications and references cited herein are expressly incorporated herein by reference in their entirety.

In the figures of this application, in some instances, a plurality of elements may be shown as illustrative of a particular element, and a single element may be shown as illustrative of a plurality of a particular elements. Showing a plurality of a particular element is not intended to imply that a system or method implemented in accordance with the concepts, structures and techniques described herein must comprise more than one of that element or step. Nor is it intended by illustrating a single element that the concepts, structures and techniques are/is limited to embodiments having only a single one of that respective element. Those skilled in the art will recognize that the numbers of a particular element shown in a drawing can be, in at least some instances, are selected to accommodate the particular user needs.

It is intended that the particular combinations of elements and features in the above-detailed embodiments be considered exemplary only; the interchanging and substitution of these teachings with other teachings in this and the incorporated-by-reference patents and applications are also expressly contemplated. As those of ordinary skill in the art will recognize, variations, modifications, and other implementations of what is described herein can occur to those of ordinary skill in the art without departing from the spirit and scope of the concepts as described and claimed herein. Thus, the foregoing description is by way of example only and is not intended to be and should not be construed in any way to be limiting.

Further, in describing the concepts, structures and techniques and in illustrating embodiments of the concepts in the figures, specific terminology, numbers, dimensions, materials, etc., are used for the sake of clarity. However the concepts, structures and techniques described herein are not limited to the specific terms, numbers, dimensions, materials, etc. so selected, and each specific term, number, dimension, material, etc., at least includes all technical and functional equivalents that operate in a similar manner to accomplish a similar purpose. Use of a given word, phrase, number, dimension, material, language terminology, product brand, etc. is intended to include all grammatical, literal, scientific, technical, and functional equivalents. The terminology used herein is solely for the purpose of description and should not be construed as limiting the scope of that which is claimed herein.

Having described the preferred embodiments of the concepts sought to be protected, it will now become apparent to one of ordinary skill in the art that other embodiments incorporating the concepts may be used. Moreover, those of ordinary skill in the art will appreciate that the embodiments of the invention described herein can be modified to accommodate and/or comply with changes and improvements in the applicable technology and standards referred to herein. For example, the technology can be implemented in many other, different, forms, and in many different environments, and the technology disclosed herein can be used in combination with other technologies. Variations, modifications, and other implementations of what is described herein can occur to those of ordinary skill in the art without departing from the spirit and the scope of the concepts as described and claimed. It is felt, therefore, that the scope of protection should not be limited to or by the disclosed embodiments, but rather, should be limited only by the spirit and scope of the appended claims.

What is claimed is:

1. A quad-line balun column comprising:

a central member having a square cross-sectional shape and having four external conductive surfaces which extend from a first end to a second opposite end of said central member;

a first dielectric slab having a first surface disposed over a first portion of a first one of the four external conductive surfaces of said central member and wherein a second opposing surface of said first dielectric slab has a conductor disposed thereon wherein said first dielectric slab has a width substantially equal to the width of the first one of the four external conductive surfaces of said central member on which said first dielectric slab is disposed;

a second dielectric slab having a first surface disposed over a second portion of a second one of the four external conductive surfaces of said central member wherein said second dielectric slab has a width substantially equal to the width of the second one of the four external conductive surfaces of said central member and wherein a second opposing surface of said second dielectric slab has a conductor disposed thereon, wherein said conductor has a width substantially equal to the width of said second dielectric slab;

a third dielectric slab having a first surface disposed over a third portion of a third one of the four external conductive surfaces of said central member wherein said third dielectric slab has a width substantially equal to the width of the third one of the four external conductive surfaces of said central member and wherein a second opposing surface of said third dielectric slab has a conductor disposed thereon, wherein said conductor has a width substantially equal to the width of said third dielectric slab; and a fourth dielectric slab having a first surface disposed over a fourth portion of a fourth one of the four external conductive surfaces of said central member wherein said fourth dielectric slab has a width substantially equal to the width of the fourth one of the four external conductive surfaces of said central member and wherein a second opposing surface of said fourth dielectric slab has a conductor disposed thereon wherein said fourth dielectric slab has a width substantially equal to the width of the fourth one of the four external conductive surfaces of said central member on which said fourth dielectric slab is disposed.

2. The balun column of claim 1 wherein said central member is hollow.

3. The balun column of claim 2 wherein said central member is at least partially hollow.

4. The balun column of claim 2 wherein a width of the first, second, third and fourth dielectric slabs is not greater than a width of the sides of said central member.

5. The balun column of claim 1 wherein said central member is provided from a conductive material and the combination of said first, second, third and fourth dielectric slabs and corresponding conductors form four respective microstrip transmission lines and wherein each of the four respective microstrip transmission lines share the same ground provided by said central member.

6. The balun column of claim 1 wherein the combination of said first, second, third and fourth dielectric slabs and corresponding conductors form four respective microstrip transmission lines and wherein the four external conductive surfaces of said central member provide respective ground planes for each of said four respective microstrip transmission lines.

7. The balun column of claim 1 wherein said central member is provided from a dielectric material having conductive material disposed thereon to provide the four external conductive surfaces.

8. The balun column of claim 1 wherein said first, second, third and fourth dielectric slabs are provided having rectangular cross-sectional shapes.

9. The balun of claim 1 wherein said first, second, third, and fourth dielectric slabs extend the entire length between the first and second opposing conductive ends of said central member.

10. The balun of claim 9 wherein the conductor disposed thereon each of said first, second, third, and fourth dielectric slabs extend the entire length of said dielectric slabs.

11. The balun of claim 1 wherein:

said first, second, third, and fourth dielectric slabs extend from the first end of said central member to the second of end of said central member; and the conductors disposed on respective ones of said first, second, third, and fourth dielectric slabs extend from the first end of said central member to the second end of said central member such that a first end of said central member is capable of accepting a feed signal and a second end of said central member is capable of being coupled to a radiator.

12. An integrated antenna element comprising:

(a) a droopy bowtie antenna element having a feed point;

(b) a quad-line vertical balun column having a first end electrically coupled to the feed point of said droopy bowtie antenna element, said quad-line vertical balun column comprising:

a central member having four continuously connected conductive surfaces and first and second opposing conductive ends, said central member having a square cross-sectional shape;

a first dielectric slab having a first surface disposed over a first conductive surface of said central member and wherein a second opposing surface of said first dielectric slab has a respective conductor disposed thereon;

a second dielectric slab having a first surface disposed over a second conductive surface of said central member and wherein a second opposing surface of said second dielectric slab has a respective conductor disposed thereon;

a third dielectric slab having a first surface disposed over a third conductive surface of said central member and wherein a second opposing surface of said third dielectric slab has a respective conductor disposed thereon; and a fourth dielectric slab having a first surface disposed over a fourth conductive surface of said central member and wherein a second opposing surface of said fourth dielectric slab has a respective conductor disposed thereon.

13. An integrated antenna element comprising:

(a) a droopy bowtie antenna element having a feed point, said droopy bowtie antenna comprising:

a dielectric radiator block having a height h and having cavity region formed therein with the cavity region having a generally truncated pyramidal shape with a pair of opposing surfaces and a feed point provide at the center point of the cavity; and a conductive layer disposed on each of the surfaces, each of the conductive layers having a generally triangular shape with one vertices terminating proximate the feed point;

(b) a quad-line vertical balun column having a first end electrically coupled to the feed point of said droopy bowtie antenna element, said quad-line vertical balun column comprising:

a central member having four continuously connected conductive surfaces and first and second opposing conductive ends, said conductive member having a contiguous square cross-sectional shape;

a first dielectric slab having a first surface disposed over a first conductive surface of said central member and wherein a second opposing surface of said first dielectric slab has a respective conductor disposed thereon;

a second dielectric slab having a first surface disposed over a second conductive surface of said central member and wherein a second opposing surface of said second dielectric slab has a respective conductor disposed thereon;

a third dielectric slab having a first surface disposed over a third conductive surface of said central member and wherein a second opposing surface of said third dielectric slab has a respective conductor disposed thereon; and a fourth dielectric slab having a first surface disposed over a fourth conductive surface of said central member and wherein a second opposing surface of said fourth dielectric slab has a respective conductor disposed thereon.

14. The antenna of claim 13 wherein the surfaces of the cavity are one of:

a) a flat shape;

b) a concave shape; and c) a convex shape.

15. The antenna of claim 14 further comprising a support block over which said radiator block is disposed, said support block having an opening therein to expose the feed port of said radiator block and wherein said balun is disposed through the opening in said support block.

* * * * *